US008084106B2

(12) United States Patent
Nakano et al.

(10) Patent No.: US 8,084,106 B2
(45) Date of Patent: Dec. 27, 2011

(54) INKJET RECORDING MEDIUM AND METHOD OF MANUFACTURING THE SAME

(75) Inventors: Ryoichi Nakano, Fujinomiya (JP); Hirokazu Shimada, Fujinomiya (JP)

(73) Assignee: Fujifilm Corporation, Tokyo (JP)

( * ) Notice: Subject to any disclaimer, the term of this patent is extended or adjusted under 35 U.S.C. 154(b) by 882 days.

(21) Appl. No.: 12/055,092

(22) Filed: Mar. 25, 2008

(65) Prior Publication Data

US 2008/0241437 A1 Oct. 2, 2008

(30) Foreign Application Priority Data

Mar. 30, 2007 (JP) ..... 2007-094272

(51) Int. Cl.
*B41M 5/40* (2006.01)

(52) U.S. Cl. ..... 428/32.24; 428/32.25; 428/32.26; 428/32.28; 428/32.34

(58) Field of Classification Search ..... 428/32.24, 428/32.25, 32.26, 32.28, 32.34
See application file for complete search history.

(56) References Cited

U.S. PATENT DOCUMENTS

| | | | | |
|---|---|---|---|---|
| 6,177,177 | B1 * | 1/2001 | Herrmann et al. | 428/212 |
| 6,492,005 | B1 * | 12/2002 | Ohbayashi et al. | 428/32.29 |
| 2003/0068476 | A1 * | 4/2003 | Yamada et al. | 428/195 |

FOREIGN PATENT DOCUMENTS

| | | | |
|---|---|---|---|
| JP | 10119423 | A | 5/1998 |
| JP | 10217601 | A | 8/1998 |
| JP | 2002096546 | A | 4/2002 |
| JP | 2003-1931 | A | 1/2003 |
| JP | 2003285535 | A | 10/2003 |
| JP | 2004-262175 | A | 9/2004 |
| JP | 2006321176 | A | 11/2006 |
| JP | 2007-76151 | A | 3/2007 |

* cited by examiner

*Primary Examiner* — Betelhem Shewareged
(74) *Attorney, Agent, or Firm* — Sughrue Mion, PLLC

(57) ABSTRACT

There are provided an inkjet recording medium having on a substrate an ink-receiving layer containing inorganic fine particles and a sulfur compound, with the sulfur compound being contained in a greater quantity in half of the ink-receiving layer at a side nearer to the substrate than in half of the ink-receiving layer at a side further from the substrate when the ink-receiving layer is divided into two equal parts by a plane parallel to the substrate, and a manufacturing method thereof.

11 Claims, No Drawings

INKJET RECORDING MEDIUM AND METHOD OF MANUFACTURING THE SAME

CROSS-REFERENCE TO RELATED APPLICATION

This application claims priority under 35 USC 119 from Japanese Patent Application No. 2007-094272, the disclosure of which is incorporated by reference herein.

BACKGROUND OF THE INVENTION

1. Field of the Invention

The present invention relates to an inkjet recording medium and a method of manufacturing such a medium.

2. Description of the Related Art

With recent rapid advances in the information-technology industry, a wide variety of information-processing systems have been developed, and recording methods and apparatus suitable for respective uses in those information-processing systems have also been developed and put to practical use.

Of those recording methods, an inkjet recording method has been widely adopted not only in offices but also for the so-called at-home recording because of its advantages that it allows recording on various kinds of recording materials and the hardware (apparatus) required thereby is relatively inexpensive, compact and extremely quiet.

In addition, as the resolution of images printed by inkjet printers has been enhanced in recent years, it has become possible to obtain records of the so-called photograph-like high quality, and with such an evolution of the hardware (apparatus), various kinds of inkjet recording media have been developed.

In general, the properties required of recording sheets for inkjet recording use include properties of (1) ensuring quick drying of ink (absorbing ink with great speed), (2) ensuring ink dots of correct and uniform diameter (being free of bleeding), (3) ensuring good graininess, (4) ensuring highly round ink dots, (5) ensuring high color densities, (6) ensuring high saturation (no dullness), (7) ensuring high resistance to water, light and ozone in the printed portion, (8) having high whiteness degree in the background portion, (9) having good storability (causing neither yellow coloration even upon long-term storage nor bleeding of images by long-term storage (bleeding with age)), (10) having high resistance to deformation and good dimensional stability (being minuscule in curling), and (11) ensuring smooth running in apparatus.

When recording sheets are used as glazed photo paper for the purpose of obtaining the so-called photograph-like high-quality records, they are further required to have glossiness, surface smoothness and texture resembling that of photographic printing paper for silver-salt photograph in addition to the properties recited above.

With the aim of improving those properties, inkjet recording media having porous structures in their respective ink-receiving layers have been developed and put to practical use in recent years. By having porous structures, such inkjet recording media can have excellent ink receptivity (quick-dry properties) and high glossiness.

For example, the inkjet recording media each having on a substrate an ink-receiving layer containing fine particles of inorganic pigment and a water-soluble resin, thereby having a high porosity, have been put forth (See, e.g., JP-A Nos. 10-119423 and 10-217601).

Owing to their makeup, those recording media, notably the inkjet recording medium provided with an ink-receiving layer having a porous structure using silica as fine particles of inorganic pigment, have high ink absorbency and ink receptivity high enough to form images of high resolution, and can show a high gloss.

On the other hand, among ingredients incorporated into an ink-receiving layer, sulfur compounds are known as a component capable of improving ozone resistance (See, e.g., JP-A Nos. 2002-96546, 2003-285535 and 2006-321176).

However, there are cases where incorporation of sulfur compounds into ink-receiving layers causes reduction in image density.

SUMMARY OF THE INVENTION

The present invention has been made in view of the above circumstances, and provides an inkjet recording medium and a method of manufacturing such a medium.

A first aspect of the invention provides an inkjet recording medium comprising, on a substrate, an ink-receiving layer comprising, inorganic fine particles and a sulfur compound, the sulfur compound being contained in a greater quantity in a half of the ink-receiving layer at a side nearer to the substrate (a near-substrate side) than in a half of the ink-receiving layer at a side further from the substrate (a far-substrate side) when the ink-receiving layer is divided into two equal parts by a plane parallel to the substrate.

A second aspect of the invention provides a method of manufacturing an inkjet recording medium, comprising:

forming a coating layer on a substrate by applying to the substrate at least a first solution A containing inorganic fine particles and a sulfur compound and a first solution B differing from the first solution A in composition in this order from the substrate, and performing cross-link curing of the coating layer by applying a second solution containing a basic compound at either (1) the same time as at least the first solution A and the first solution B are applied or (2) a stage in the course of drying of the coating layer formed by applying at least the first solution A and the first solution B before the coating layer shows decreasing-rate drying, wherein an ink-receiving layer is formed that includes the coating layer having undergone the cross-link curing and contains the sulfur compound in a greater quantity in half at a side nearer to the substrate (a near-substrate side) than in half at a side further from the substrate (a far-substrate side) when the ink-receiving layer is divided into two equal parts by a plane parallel to the substrate.

A third aspect of the invention provides a method of manufacturing an inkjet recording medium, comprising:

forming a coating layer on a substrate by applying to the substrate at least a first solution A containing inorganic fine particles and a sulfur compound and a first solution B differing from the first solution A in composition in this order from the substrate, cooling the coating layer to a temperature at least 5° C. lower than a lower temperature of temperatures at which the first solution A and the first solution B are applied respectively, and forming an ink-receiving layer by drying the cooled coating layer, wherein the formed ink-receiving layer contains the sulfur compound in a greater quantity in half at a side nearer to the substrate (a near-substrate side) than in half at a side further from the substrate (a far-substrate side) when the ink-receiving layer is divided into two equal parts by a plane parallel to the substrate.

DETAILED DESCRIPTION OF THE INVENTION

In accordance with the present invention, it is possible to provide an inkjet recording medium that allows retention of high image densities while improving ozone resistance of images recorded thereon, and to provide a method of manufacturing such an inkjet recording medium.

The invention is described below in detail.

<<Inkjet Recording Medium>>

An inkjet recording medium according to the invention has on a substrate an ink-receiving layer containing inorganic fine particles and a sulfur compound, and the ink-receiving layer is structured to contain the sulfur compound in a greater quantity in a half part near the substrate (hereafter also referred to as the lower-side half of the ink-receiving layer) than in a half part distant from the substrate (hereafter also referred to as the upper-side half of the ink-receiving layer) when it is divided into two equal parts by a plane parallel to the substrate.

The presence distribution of the sulfur compound in the ink-receiving layer can be ascertained by elemental analysis. Specifically, the ascertainment may be made by performing mapping analysis according to the SEM-EDX method and observing the images obtained. In this case, the presence position of the ink-receiving layer as a whole is ascertained first by mapping analysis of the main component (e.g., elemental Si) of the ink-receiving layer, and then the mapping analysis of elemental S is performed. By the mapping image thus obtained, which part of the ink-receiving layer, the upper-side half or the lower-side half, contains elemental S in a greater quantity is judged.

By being so structured as described above, the present inkjet recording medium can retain high image densities while improving ozone resistance of the images recorded thereon. When an ink-receiving layer is so structured that one-half the ink-receiving layer at the near-substrate side and the other at the far-substrate side become equal in quantity of a sulfur compound contained therein, or a sulfur compound is present in a greater quantity in one-half the ink-receiving layer at the far-substrate side than in the other at the near-substrate side, the densities of images recorded are lowered.

The present inkjet recording medium has no particular restrictions as to its manufacturing method, but it can be manufactured favorably by methods according to the invention as described hereinafter.

In the invention, the ratio of sulfur compound contents in the ink-receiving layer [content (by mass) in the upper-side half of the ink-receiving layer/content (by mass) in the lower-side half of the ink-receiving layer] is required to be smaller than 1.0.

From the viewpoint of more effectively achieving the effects of the invention, the ratio between the contents is preferably from 0 to 0.6, far preferably from 0 to 0.3, particularly preferably 0 (namely, a state of being free of a sulfur compound in the upper-side half).

An ink-receiving layer containing a sulfur compound in the content ratio range as specified above can be formed, e.g., by adjusting the content ratio of the sulfur compound [content in the first solution B/content in the first solution A] as specified below when the inkjet recording medium is manufactured in accordance with the method as described hereinafter.

In addition, from the viewpoints of more effectively achieving the effects of the invention, the sulfur compound content in the lower-side half of the ink-receiving layer is preferably from 1% to 20% by mass, far preferably from 3% to 15% by mass, particularly preferably from 4% to 10% by mass, based on the total solids in the lower-side half.

On the other hand, the sulfur compound content in the upper-side half of the ink-receiving layer in view of more effectively achieving the effects of the invention is preferably from 0 to 5% by mass, far preferably from 0 to 3% by mass, particularly preferably 0% by mass (namely, a state of being free of sulfur compound in the upper-side half), based on the total solids in the upper-side half.

Moreover, from the viewpoints of more effectively achieving the effects of the invention, the sulfur compound content in the whole ink-receiving layer into which the upper-side half and the lower-side half are united is preferably from 0.5% to 5% by mass, far preferably 1% to 4% by mass, particularly preferably from 1.5% to 3% by mass, based on the total solids in the whole ink-receiving layer.

Additionally, the expression "total solids in the ink-receiving layer" used in the invention means all ingredients but water which constitute the ink-receiving layer.

<Ink-Receiving Layer>

The present ink-receiving layer may be formed of only one layer, or it may be composed of two or more layers. When the two or more layers constituting the ink-receiving layer are integrated and regarded as one ink-receiving layer, and besides, upper-side half and lower-side half of the integrated ink-receiving layer are recognized, it is required that the sulfur compound be contained in a greater quantity in the lower-side half of the ink-receiving layer than in the upper-side half of the ink-receiving layer.

In another viewpoint of enhancing glossiness of the ink-receiving layer, it is preferable to take a form that the present ink-receiving layer includes two or more layers and contains colloidal silica in the uppermost layer most distant from the substrate. The uppermost layer containing colloidal silica is referred to as "a colloidal silica layer" too.

From the viewpoint of ensuring absorption capacity high enough to absorb all of droplets, it is preferred that the ink-receiving layer thickness is determined in conjunction with porosity in the layer. When the ink quantity is 8 nL/mm$^2$ and the porosity is 60%, for instance, the layer thickness of about 15 μm or more is required.

In consideration of such a point, the thickness of the ink-receiving layer is preferably from 10 to 50 μm, far preferably from 20 to 40 μm.

On the other hand, the thickness of the colloidal silica layer, which is included in the ink-receiving layer in some cases, is preferably from 0.05 to 5 μm, far preferably from 0.1 to 3 μm, from the viewpoints of ink absorbance and glossiness.

In addition, the diameter of pores in the ink-receiving layer is preferably from 0.005 to 0.030 μm, far preferably from 0.01 to 0.025 μm, in terms of median diameter.

The porosity and the median diameter of pores can be measured with a mercury porosimeter (PORESIZER 9320-PC2, trade name, a product of Shimadzu Corporation).

Moreover, it is preferable that the ink-receiving layer has excellent transparency. As an index of transparency, the haze value measured when the ink-receiving layer is formed on a transparent film substrate is adopted, and it is preferably 30% or less, far preferably 20% or less.

The haze value can be measured with a haze meter (HGM-2DP, trade name, a product of SUGA TEST INSTRUMENTS).

The sulfur compound and inorganic fine particles as essential components of the present ink-receiving layer are described below, and then descriptions of optional components including a water-soluble resin, a magnesium salt, colloidal silica, a crosslinking agent, a water-soluble polyvalent metal salt, a mordant and other ingredients are given.

(Sulfur Compound)

The ink-receiving layer in the invention contains at least one kind of sulfur compound.

The sulfur compound used suitably in the invention is at least one kind of sulfur compound selected from thioether compounds, thiourea compounds, sulfoxide compounds, thiocyanic acid compounds, sulfinic acid compounds, disulfide compounds or sulfur-containing heterocyclic compounds.

Thioether Compound

The thioether compounds may be water-soluble or oil-soluble compounds. In addition, they may be low-molecular-weight or high-molecular-weight compounds, and it is essential only that they contain at least one thioether group per molecule.

The number of carbon atoms in each thioether compound is preferably 2 or more, far preferably 4 or more.

In addition to sulfur, carbon and hydrogen atoms, it is preferable that the thioether compounds further contain atoms having lone-electron pairs (e.g., oxygen, sulfur, nitrogen, phosphorus).

Examples of such a thioether compound include compounds represented by the following formula (1).

$$R_1—(S—R_3)m\text{-}S—R_2 \quad (1)$$

In formula (1), $R_1$ and $R_2$ each independently represent a hydrogen atom, a substituted or unsubstituted alkyl group, a substituted or unsubstituted aryl group, or a group containing any of such groups. Alternatively, $R_1$ and $R_2$ may be the same or different, and combine with each other to form a ring. However, it is required for at least either $R_1$ or $R_2$ to represent an alkyl group having as a substituent a hydrophilic group, such as a hydroxyl group, a sulfo group, a carboxyl group or a (poly)ethyleneoxy group, or a group having a basic nitrogen atom, such as an amino group, an amido group, an ammonium group, a nitrogen-containing heterocyclic group, an aminocarbonyl group or an aminosulfonyl group; or a group containing such a substituted alkyl group (in other words, such a substituted alkyl group may be bound to the thioether sulfur via a divalent linkage group, such as a carbamoyl group, a carbonyl group or a carbonyloxy group). $R_3$ represents an alkylene group which may be substituted, and may contain an oxygen atom in some cases. m represents an integer of 0 to 10 and, when m is 1 or more, it is also possible that at least one sulfur atom bound to $R_3$ is a sulfoxide group or a sulfonyl group. $R_1$ and $R_2$ each may be a polymer residue too.

Of the compounds represented by formula (1), those especially preferred are the compounds each having as at least either $R_1$ or $R_2$ an alkyl group substituted with a hydroxyl group, a carboxyl group, an amino group or an ammonium group. In addition, the amino moiety in such an aminoalkyl group may be an amino group, a monoalkyl(preferably 1-5C alkyl)amino group, a dialkyl(preferably 1-5C alkyl)amino group or a nitrogen-containing heterocyclic group. Examples of a compound represented by formula (1) are illustrated below, but the invention should not be construed as being limited to these examples.

(1) $HO(CH_2)_3S(CH_2)_3OH$ (2) $CH_3SCH_2CH(NH_2)COOH$ (3) $HO(CH_2)_2S(CH_2)_2N(CH_3)_2$

-continued (4) $HO(CH_2)_2S(CH_2)_2OH$ (5) $CH_3S(CH_2)_2CH(NH_2)COOH$ (6) $HO(CH_2)_2SCH_2S(CH_2)_2OH$ (7) $HO(CH_2)_2S(CH_2)_2S(CH_2)_2OH$ (8) $HO(CH_2)_2S(CH_2)_3S(CH_2)_2OH$ (9) $C_2H_5S(CH_2)_2SCH_2CHOHCH_2OH$

(10) $HOOCCH_2SCH_2SCH_2COOH$

(11) $S(CH_2)_2O(CH_2)_2)_2$

(12) $HO(CH_2)_2S(CH_2)_2SO_2(CH_2)_2S(CH_2)_2OH$

(13) $HO(CH_2)_3S(CH_2)_2S(CH_2)_3OH$

(14) $HOOCCH_2SCH_2COOH$

(15) $HOOCCH_2S(CH_2)_3SCH_2COOH$

(16) $HOOCCH_2S(CH_2)_2SCH_2COOH$

(17) $HO(CH_2)_2S(CH_2)_4S(CH_2)_2OH$

(18) $HO(CH_2)_2S(CH_2)_2S(CH_2)_2S(CH_2)_2OH$

(19) $HOOC(CH_2)_2S(CH_2)_2S(CH_2)_2COOH$

(20) $HOOC(CH_2)_2S(CH_2)S(CH_2)_2COOH$

(21) $(HO(CH_2)_2S(CH_2)_2)_2O$

(22) $H_2NCO(CH_2)_2S(CH_2)_2S(CH_2)_2CONH_2$

(23) $HOOC(CH_2)_2S(CH_2)_2COOH$

(24) $(HOCH_2CHOHCH_2SCH_2)_2$

(25) $HOOC(CH_2)_2S(CH_2)_3S(CH_2)_2COOH$

(26) $C_2H_5S(CH_2)_2S(CH_2)_2NHCO(CH_2)_2COOH$

(27) $HO(CH_2)_3S(CH_2)_2O(CH_2)_3O(CH_2)_2S(CH_2)_2OH$

(28) $HO(CH_2)_5S(CH_2)_6S(CH_2)_5OH$

(29) $(CH_3)_2N(CH_2)_2S(CH_2)_2N(CH_3)_2$

(30) $(CH_3)_2N(CH_2)_2S(CH_2)_2S(CH_2)_2S(CH_2)_2N(CH_3)_2 \cdot 2HCl$

(31) $(CH_3)_2N(CH_2)_2S(CH_2)_2S(CH_2)_2S(CH_2)_2S(CH_2)_2N(CH_3)_2 \cdot 2HCl$ -continued (32)

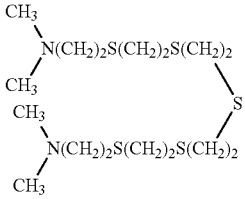

(33)

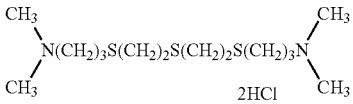

(34)

$H_2N(CH_2)_3S(CH_2)_2S(CH_2)_2S(CH_2)_3NH_2$

2HCl (35)

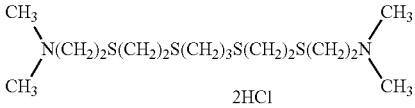

(36)

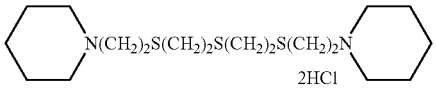

(37)

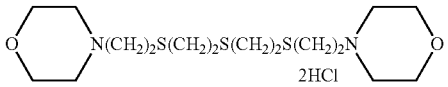

(38)

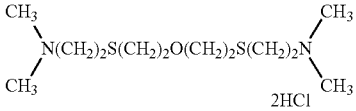

(39)

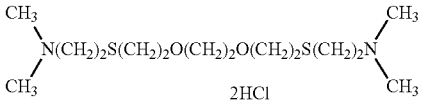

(40)

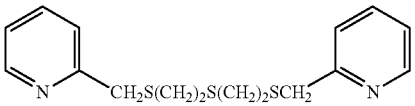

$2(CO_2H)_2$ (41)

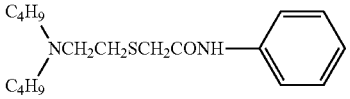

(42)

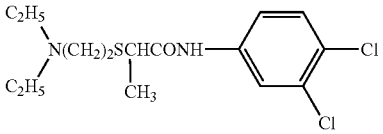

(43)

$(CH_3)_3N^+(CH_2)_2S(CH_2)_2N^+(CH_3)_3 \cdot 2CH_3SO_3^-$ (44)

$(CH_3)_3N^+(CH_2)_2S(CH_2)_2S(CH_2)_2N^+(CH_3)_3$

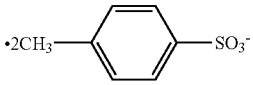

-continued (45)

$(C_2H_5)_2N^+(CH_2)_2S(CH_2)_2S(CH_2)_2N^+(C_2H_5)_2$

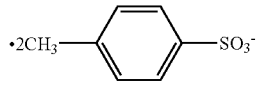

(46)

$(CH_3)_3N^+(CH_2)_3S(CH_2)_2S(CH_2)_3N^+(CH_3)_3$

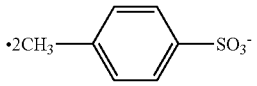

(47)

$(CH_3)_3N^+(CH_2)_2S(CH_2)_2S(CH_2)_2S(CH_2)_2N^+(CH_3)_3$

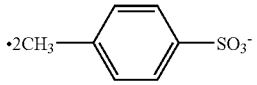

Thiourea Compound

The thiourea compounds may be water-soluble or oil-soluble compounds. In addition, they may be low-molecular-weight or high-molecular-weight compounds, and they are compounds containing at least one structure represented by >N—C(═S)—N< per molecule.

Examples of such compounds include thiourea, N-methylthiourea, N-acetylthiourea, 1,3-diphenylthiourea, tetramethylthiourea, guanylthiourea, 4-methylthiosemicarbazide, 1,3-bis(hydroxymethyl)-2(3H)-benzimidazolethione, 6-hydroxy-1-phenyl-3,4-dihydropyrimidine-2(1H)-thione, 1-allyl-2-thiourea, 1,3-dimethyl-2-thiourea, 1,3-diethyl-2-thiourea, ethylenethiourea, trimethylthiourea, 1-carboxymethyl-2-thiohydantoin and thiosemicarbazide.

Disulfide Compound

The disulfide compounds may be water-soluble or oil-soluble compounds. In addition, they may be low-molecular-weight or high-molecular-weight compounds, and the compounds represented, e.g., by the formula illustrated below are preferred. Of such compounds, DL-α-lipoic acid, 4,4'-dithiodimorpholine and 4,4'-dithiodibutanoic acid in particular are used to advantage.

$R_1—S—S—R_2$

In the above formula, $R_1$ and $R_2$ each represent an organic group containing a carbon or nitrogen atom bound to the corresponding sulfur atom of the disulfide bond. Such an organic group may be a group in conjunction with the carbon or nitrogen atom bound to the disulfide sulfur to form a substituted or unsubstituted aliphatic group, a substituted or unsubstituted aromatic group or a substituted or unsubstituted heterocyclic group, or an organic group formed by binding a substituted or unsubstituted aliphatic, aromatic, heterocyclic or amino group, and an imino group, oxygen atom or sulfur atom to the carbon or nitrogen atom bound to the disulfide sulfur. Alternatively, $R_1$ and $R_2$ may be the same or different, and they may combine with each other to form a ring. Examples of substituents which may be contained in groups represented by $R_1$ and $R_2$ include an alkyl group, an aryl group, a heterocyclic group, an amino group, an amido group, an imino group, an ammonium group, a hydroxyl group, a sulfo group, a carboxyl group, an aminocarbonyl group, an aminosulfonyl group and a halogen atom.

Sulfinic Acid Compound

The sulfinic acid compounds may be water-soluble or oil-soluble compounds. In addition, they may be low-molecular-weight or high-molecular-weight compounds, and it is essential only that they contain at least one sulfinic acid skeleton per molecule.

As the sulfinic acid compound for use in the invention, compounds represented by the following formula are suitable.

$$R—SO_2M$$

In the above formula, R represents a substituted or unsubstituted alkyl group (preferably having 6 to 30 carbon atoms), a substituted or unsubstituted aryl group (preferably having 6 to 30 carbon atoms, such as a phenyl group or a naphthyl group), or a polymer residue. M represents a hydrogen atom, an alkali metal atom or ammonium.

Examples of a substituent of the group represented by R include a linear, branched or cyclic alkyl group (preferably having 1 to 20 carbon atoms), an aralkyl group (preferably a mono- or di-cyclic group whose alkyl moiety has 1 to 3 carbon atoms), an alkoxy group (preferably having 1 to 20 carbon atoms), a mono- or di-substituted amino group (each substituent of which is preferably a 1-20C alkyl, acyl, alkylsulfonyl or arylsulfonyl group, provided that the total number of carbon atoms in the two substituents is 20 or less), a mono- to tri-substituted or unsubstituted ureido group (preferably having 1 to 20 carbon atoms), a substituted or unsubstituted aryl group (which is preferably a 6-29C mono- or di-cyclic aryl group), a substituted or unsubstituted arylthio group (preferably having 6 to 29 carbon atoms), a substituted or unsubstituted alkylthio group (preferably having 1 to 29 carbon atoms), a substituted or unsubstituted alkylsulfoxy group (preferably having 1 to 29 carbon atoms), a substituted or unsubstituted arylsulfoxy group (preferably having a 6-29C mono- or di-cyclic aryl moiety), a substituted or unsubstituted alkylsulfonyl group (preferably having 1 to 29 carbon atoms), a substituted or unsubstituted arylsulfonyl group (preferably having a 6-29C mono- or di-cyclic aryl moiety), an aryloxy group (preferably having a 6-29C mono- or di-cyclic aryl moiety), a carbamoyl group (preferably having 1 to 29 carbon atoms), a sulfamoyl group (preferably having 1 to 29 carbon atoms), a hydroxyl group, a halogen atom (fluorine, chlorine, bromine or iodine), a sulfonic acid group and a carboxylic acid group.

Each of those substituents may further have another substituent, such as an alkyl group, an aryl group, an alkoxy group, an aryloxy group, an alkylthio group, an arylthio group, an alkylsulfonyl group, an arylsulfonyl group, a carbonamide group, a sulfonamide group, a carbamoyl group, a sulfamoyl group, an alkylsulfoxy group, an arylsulfoxy group, an ester group, a hydroxyl group, a carboxyl group, a sulfo group or a halogen atom. Some of these groups may combine with each other to form a ring, or may form a part of homopolymer or copolymer chain.

Examples of such a sulfinic acid compound are illustrated below.

(A-1)

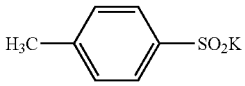

(A-2)

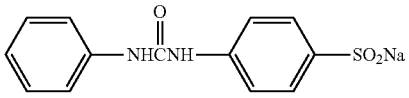

-continued (A-3)

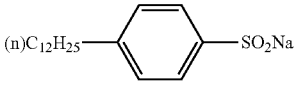

(A-4)

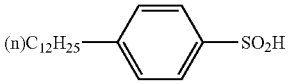

(A-5)

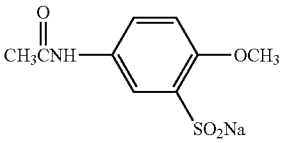

(A-6)

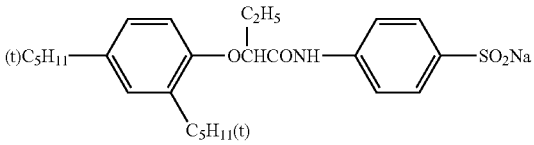

(A-7)

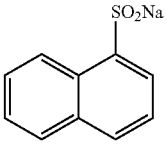

(A-8)

$(n)C_8H_{17}SO_2Na$ (A-9)

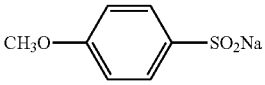

(A-10)

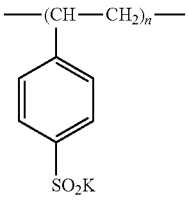

n = 6000

Thiocyanic Acid Compound

Examples of the thiocyanic acid compound for use in the invention include methyl thiocyanate, ethyl thiocyanate, sodium thiocyanate, potassium thiocyanate and calcium thiocyanate.

Sulfur-Containing Heterocyclic Compound

Examples of the sulfur-containing heterocyclic compound for use in the invention include a compound containing a sulfur atom as a constituent atom of a heterocycle, a mercapto compound having a heterocyclic substituent, and a mercapto compound having a heterocyclic substituent and a mercapto group the hydrogen of which is substituted with an alkyl group, an aryl group, an acyl group or a sulfonyl group. Of these compounds, the compounds represented by the following formula are preferred over the others.

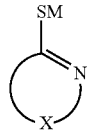

In the above formula, X represents a group of nonmetal atoms necessary to form a 5- to 7-membered ring. This group of nonmetal atoms may have a substituent. Examples of such a substituent include an alkyl group, an alkenyl group, an aryl group, an alkoxy group, an aryloxy group, an alkylthio group, an arylthio group, a hydroxyl group, an amino group, a mercapto group, a carboxyl group, an acyl group, a carbamoyl group, a sulfamoyl group, a halogen atom, and a cyano group. These substituents may further have substituents.

M represents a hydrogen atom, an ammonium ion, or a metal atom. In addition, the group having a 5- to 7-membered ring formed by containing X and another constituent may be fused together to form a condensed ring.

Examples of mercapto compounds having heterocyclic substituents include Compounds (1-1 to 1-32) disclosed in JP-A No. 2000-94829, paragraphs [0027] to [0032].

Sulfoxide Compound

The sulfoxide compound for use in the invention may be a water-soluble compound or an oil-soluble compound. In addition, the compound may be a low-molecular-weight or high-molecular-weight compound, and it is essential only that the compound have at least one sulfoxide group per molecule.

It is appropriate that the sulfoxide compound have 2 or more carbon atoms, preferably 4 or more carbon atoms.

In addition to a sulfoxide group, carbon atoms and hydrogen atoms, it is preferable that the sulfoxide compound used further contains an atom having a lone-electron pair (such as an oxygen, sulfur, nitrogen or phosphorus atom).

Examples of such sulfoxide compounds are illustrated below.

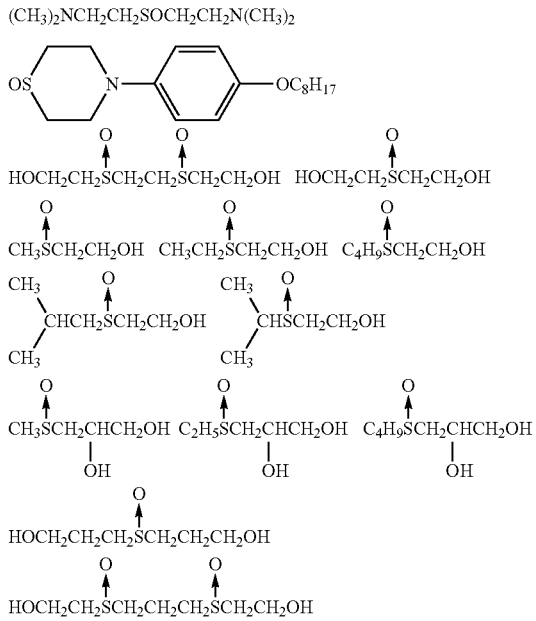

-continued

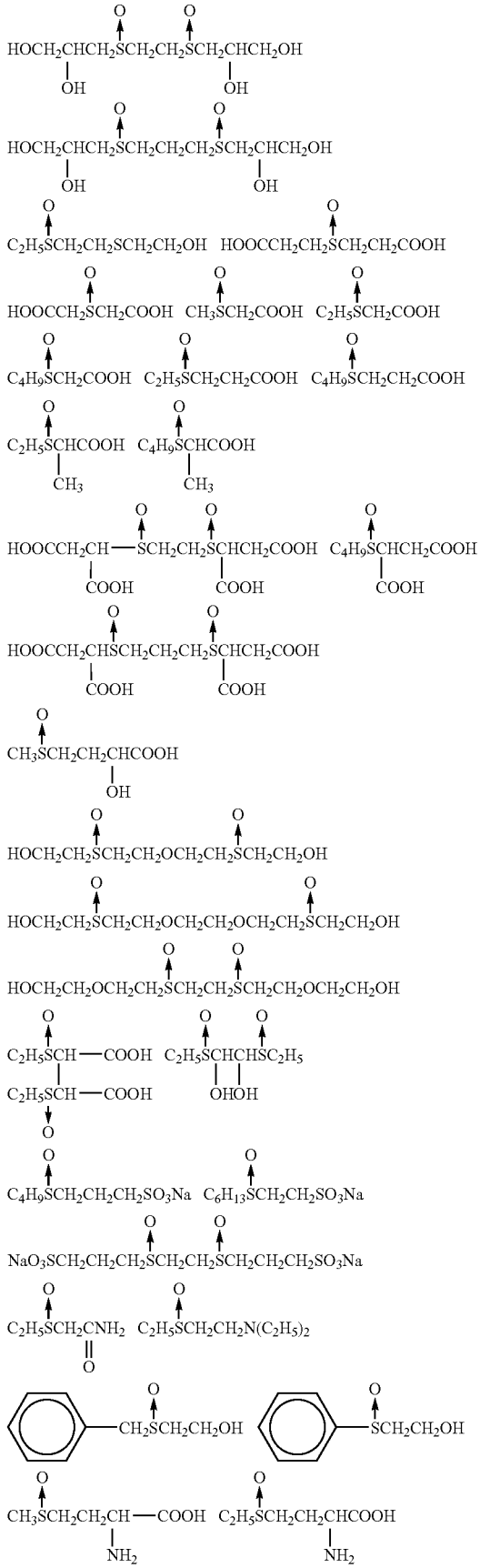

-continued
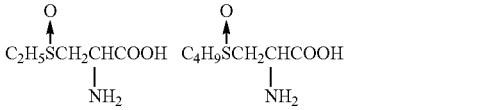
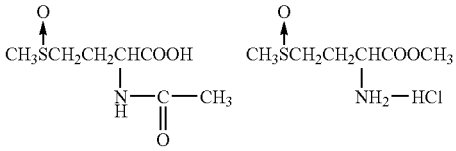
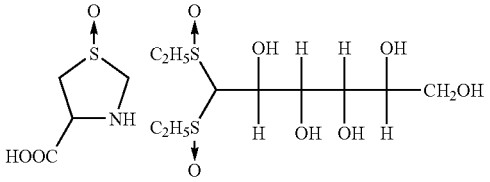
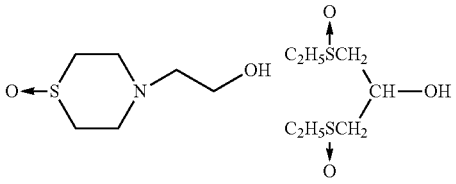
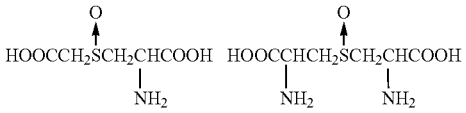
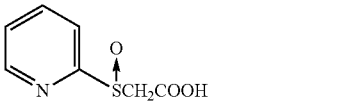
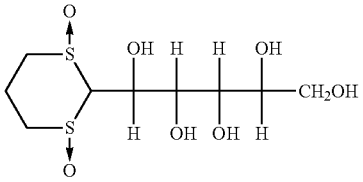
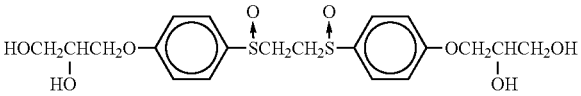
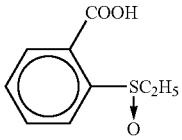
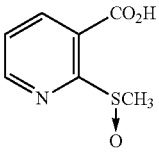
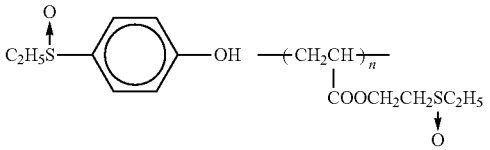
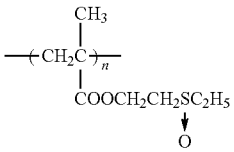
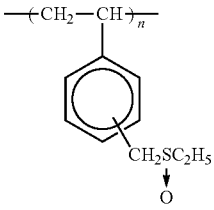
-continued
A-62)
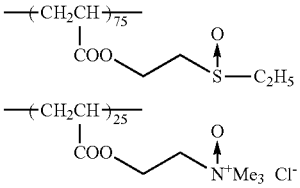
A-63)
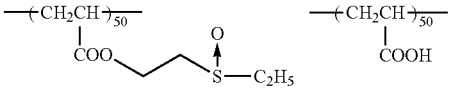
A-64)
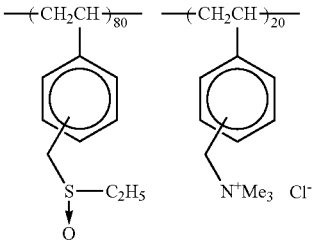
A-65)
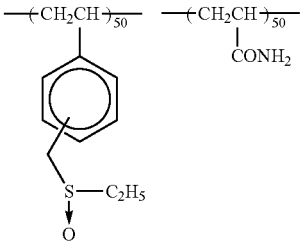
A-66)
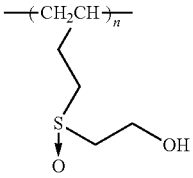
A-67)
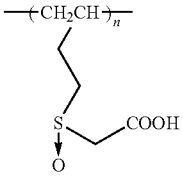
A-68)
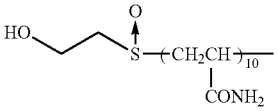
A-69)
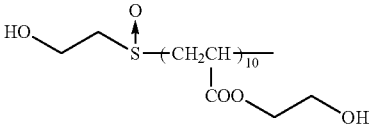
A-70)
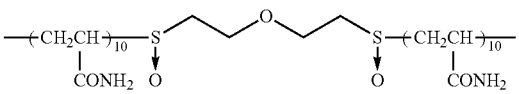

-continued

A-71)

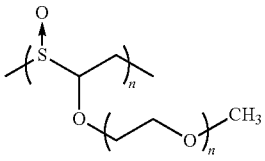

A-72)

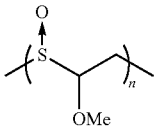

A-73)

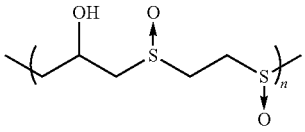

A-74)

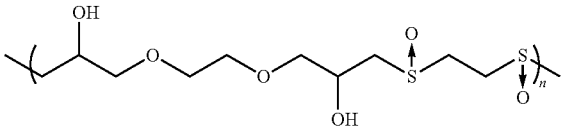

A-75)

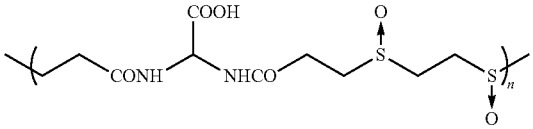

Examples of sulfur-containing compounds usable in the invention further include sulfone compounds, sulfonamide compounds, thioester compounds, thioamide compounds, sulfonic acid compounds, thiosulfonic acid compounds, thiosulfonic acid compounds, sulfamine compounds, thiocarbaminic acid compounds and sulfurous acid compounds.

The sulfur compound for use in the invention may be a polymer.

Examples of a method for synthesizing sulfur-containing polymers usable in the invention include synthesis methods utilizing polycondensation, addition polymerization, polyaddition, addition condensation, ring-opening polymerization and polymer reaction, respectively. The polymers preferably used in the invention are polymers synthesized by addition reaction. Herein, the term "addition reaction" is intended to include nucleophilic addition to carbon-carbon double bond compounds (e.g., Michael addition), nucleophilic addition to cumulative double-bond compounds (e.g., isocyanate), ring-opening addition reaction and radical addition reaction.

Examples of a polyaddition product include:

polyurethane [a polyadduct of an organic isocyanate compound having a divalent or higher isocyanate group (such as 2,4-tolylenediisocyanaate, 2,6-tolylenediisocyanate, m-phenylenediisocyanate, 4,4'-diphenylmethanediisocyanate, hexamethylenediisocyanate, octamethylenediisocyanate, 1,4-cyclohexylenediisocyanate, isophoronediisocyanate, 1,3-bis (isocyanatemethyl)cyclohexane, 1,5-diisocyanate-2-methylpentane, hydrogenated xylylenediisocyanate or hydrogenated 4,4'-diphenylmethanediisocyanate) and a polyol having any of an alkylthio group, an arylthio group, a thiocarbonyl group and a thiocyanate group (such as 2,2'-thiodiethanol, 3,6-dithia-1,8-octanediol, 1,4-diathine-2,5-diol, 3,3'-thiodipropanol, 3-methylthio-1,2-propanediol or 1,5,9,13-tetrathiacyclohexadecane-3,11-diol)];

polythiourethane [e.g., a polyadduct of an organic isothiocyanate compound having a divalent or higher isothiocyanate group (such as p-phenylene diisothiocyanate, 4,4'-methylenediphenyl isothiocyanate, isophthaloyl diisothiocyanate, hexamethylene diisothiocyanate or octamethylene diisothiocyanate) and a polyol (such as ethylene glycol, 1,3-propanediol, 1,2-propanediol, 2-methyl-1,3-propanediol, neopentyl glycol, 2,2-diethyl-1,3-propanediol, 1,4-butanediol, 1,2-butanediol or 1,6-hexanediol)];

polythiourea [e.g., a polyadduct of any of the organic isothiocyanate compounds recited above and a polyamine having an active hydrogen (e.g., ethylenediamine, 1,3-diaminopropane, 1,2-diaminopropane, 1,4-diaminobutane, hexamethylenediamine or 2,2-dimethyl-1,3-propanediamine)];

polysulfide [e.g., a ring-opening polymer of a cyclic sulfide (such as ethylene sulfide, propylene sulfide, trimethylene sulfide or 3-methoxythioethane)];

polyamide sulfide [e.g., a Michael adduct of methylenebisacrylamide and a dithiol (such as 1,2-ethanedithiol, 1,3-propanedithiol, 1,4-butanedithiol, 2,3-butanedithiol, 1,6-hexanedithiol, 1,8-octanedithiol, 2,3-dimercapto-1-propanol, dithiothreitol, dithoerythritol, or 2-mercaptoethyl ether)];

polyether sulfide [e.g., a ring-opening polyadduct of a bisepoxy compound (such as ethylene glycol diglycidyl ether, neopentyl glycol diglycidyl ether, 1,4-butanediol diglycidyl ether, polyethylene glycol, diglycidyl ether, 1,2,5,6-diepoxycyclooctane or 4-vinyl-1-cyclohexene diepoxide) and any of the dithiol compounds recited above]; and polysulfone sulfide [e.g., a polyadduct of divinylsulfone and any of the dithiol compounds recited above].

Examples of a addition polymer include homo- and copolymers of vinyl monomers having any of alkylthio, arylthio, thiocarbonyl and thiocyanate groups (such as 2-methylthioethyl (meth)acrylate, 2-ethylthioethyl(meth)acrylate, 2-(hydroxyethylthio)ethyl(meth)acrylate, 4-vinylbenzylmethyl sulfide, 4-vinylbenzylthioacetate, 2-thiocyanatoethyl vinyl ether and vinyl thiocyanatoacetate). Alternatively, addition polymers can also be prepared by subjecting conjugated vinyl monomers to telomerization using as a chain transfer agent a mercapto compound (such as 2-mercaptoethanol, ethanethiol, methylthioglycolate, thioglycerol, 2-aminoethanethiol, mercaptoacetic acid, 1,2-ethanedithiol, 1,3-propanedithiol, 1,4-butanedithiol, 2,3-butanedithiol, 1,6-hexanedithiol, 1,8-octanedithiol, 2,3-dimercapto-1-propanol, dithiothreitol, dithioerythritol, 2-mercaptoethyl ether, trimethylolpropane tris(2-mercaptoacetate), or pentaerythritol tetrakis(2-mercaptoacetate)).

Furthermore, polymers usable in the invention can be synthesized by polymer reaction. Examples of polymers synthesized by polymer reaction include radical adducts of polymers having unsaturated double bonds (e.g., polybutadiene, polyisoprene) and mercapto compounds (e.g., 2-mercaptoethanol, thioglycerol, mercaptoacetic acid, mercaptopropionic acid, 2-aminoethanethiol, 2-dimethylaminoethanethiol hydrochloride, 2-diethylaminoethanethiol hydrochloride, 3-mercaptopropanesulfonic acid), and adducts of polyamines (e.g., polyallylamine, polyvinylamine, polyethyleneimine) and isothiocyanate compounds (e.g., methyl isothiocyanate, ethyl isothiocyanate, butyl isothiocyanate, allyl isothiocyanate, cyclohexyl isothiocyanate, ethoxycarbonyl isothiocyanate).

As the polymers usable in the invention, polymers having alkylthio groups are preferred, and polymers having hydrophilic groups (such as hydroxyl, carboxyl, sulfo, carbamoyl, sulfamoyl, amino, ammonio, or amidino groups) in addition to alkylthio groups are especially preferred.

As to the polymers usable in the invention, polyurethane resins having alkylthio groups are far preferred, and cationic polyurethane resins prepared by using as comonomers tertiary amine compounds having one or more hydroxyl groups at the time of polyurethane synthesis and treating the copolymerization products with quaternarization agents. Examples of such tertiary amines include N,N-dimethylethanolamine, N,N-diethylethanolamine, 3-dimethylamino-1-propanol, 1-dimethylamino-2-propanol, 2-dimethylamino-2-methyl-1-propanol, N-methyldiethanolamine, N-ethyldiethanolamine, N-butyldiethanolamine, triethanolamine, triisopropanolamine, 3-(dimethylamino)-1,2-propanediol, 2-{[2-(dimethylamino)ethyl]-methylamino}ethanol, 1,3-bis(dimethylamino)-2-propanol, and N,N,N',N'-tetrakis(2-hydroxypropyl)-ethylenediamine. And examples of quaternarization agents usable therein include dimethyl sulfate, diethyl sulfate, methyl p-toluenesulfonate, ethyl p-toluenesulfonate, and halides (such as methyl chloride, methyl bromide, methyl iodide, benzyl chloride and benzyl bromide).

The weight-average molecular weight of those polymers usable in the invention is preferably from 1,000 to 1,000,000, far preferably from 2,000 to 100,000. When the polymers have weight-average molecular weight lower than 1,000, they cannot produce improvements in water resistance and bleeding with age; while, when the weight-average molecular weight is higher than 1,000,000, handling suitability is degraded in some cases.

The preferred among those polymers usable in the invention are polymers having solubility in water or organic solvents miscible in water, or polymers stable in the form of aqueous emulsified dispersions. The expression "polymers having solubility in water" used in the invention refers to high-molecular substances having water solubility of 0.1% or more by mass at an ambient temperature of 25° C., and the water solubility is preferably 0.5% or more by mass, particularly preferably 1% or more by mass.

On the other hand, the foregoing expression of "polymers stable in the form of aqueous emulsified dispersions" refers to high-molecular substances capable of being stably emulsified and dispersed in an aqueous dispersion medium in concentrations of 0.5% or higher by mass at an ambient temperature of 25° C., and the concentrations are preferably 1% or higher by mass, particularly preferably 3% or higher by mass.

As the sulfur-containing polymers, polymers having partial structures represented by the following formula are used to advantage.

P—Y—S—

In the above formula, P represents a polymer or oligomer residue having repeating units. Y represents a single bond or a divalent linkage group. Suitable examples of such a divalent linkage group include ether linkage, ester linkage, thioester linkage, carbonate linkage, a carbamoyl group, an alkylene group (such as a methylene group, an ethylene group, a propylene group, a trimethylene group, a tetramethylene group, a hexamethylene group or an octamethylene group), an arylene group (such as a phenylene group), or groups formed by combining any of those recited above.

Of these polymers, polymers having the following structural units are preferred over the others.

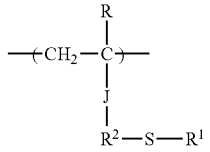

In the above formula, R represents a hydrogen atom or a methyl group. J represents a single bond or a divalent linkage group (e.g., —O—, —COO—, —OCO—, —CONR'—). $R^1$ represents an aliphatic group or an aromatic group. Such an aliphatic group is preferably an alkyl group, with examples including a methyl group, an ethyl group, an n-propyl group, an isopropyl group, an n-hexyl group, a cyclohexyl group, an n-octyl group, a 2-ethylhexyl group, a decyl group and a dodecyl group. These groups each may have a substituent (such as a hydroxyl group, a carboxyl group, a sulfo group, an alkyloxycarbonyl group, a carbamoyl group, a sulfamoyl group, a cyano group, an amino group, an ammonio group or an alkoxy group). Examples of such an aromatic group include an aryl group (such as a phenyl group or a naphthyl group), an aralkyl group (such as a benzyl group) and a pyridyl group. Of these groups, the group preferred as $R^1$ is a 1-12C (substituted)alkyl group, with examples including a methyl group, an ethyl group, a hydroxyethyl group, a 2,3-dihydroxypropyl group, a 2-carboxyethyl group, a 3-carboxypropyl group, a 3-sulfoxypropyl group, a 2-aminoethyl group, an N,N-dimethylaminoethyl group and a trimethylammonioethyl group. $R^2$ represents an alkylene group which may have a substituent (such as an methylene group, an ethylene group, a propylene group, a trimethylene group, a tetramethylene group, a hexamethylene group or an octamethylene group) or an arylene group (such as a phenylene group), preferably a 1-8C (substituted) alkylene group.

Additionally, it is advantageous for the polymer used in the invention to further have hydrophilic groups. Examples of such hydrophilic groups include a hydroxyl group, a carboxyl group, a sulfo group, a carbamoyl group, a sulfamoyl group, an amino group, an ammonio group and an amidino group. Of these groups, hydroxyl, ammonio, amino and carbamoyl groups are preferred over the others.

Those polymers usable in the invention are polymers having solubility in water, or polymers stable in the form of aqueous emulsified dispersions. The expression of "polymers having solubility in water" used in the invention refers to high-molecular substances having water solubility of 0.1% or more by mass at an ambient temperature of 25° C., and the water solubility is preferably 0.5% or more by mass, particularly preferably 1% or more by mass.

On the other hand, the foregoing expression of "polymers stable in the form of aqueous emulsified dispersions" refers to high-molecular substances capable of being stably emulsified and dispersed in an aqueous-based dispersion medium in concentrations of 0.5% or higher by mass at an ambient temperature of 25° C., and the concentrations are preferably 1% or higher by mass, particularly preferably 3% or higher by mass.

The weight-average molecular weight of those polymers usable in the invention is preferably from 1,000 to 1,000,000, far preferably from 1,000 to 100,000. When the polymers have weight-average molecular weight lower than 1,000, they cannot produce improvement effects in water resistance and bleeding with age; while, when the weight-average molecular weight is higher than 1,000,000, reduction in handling suitability can occur.

Examples of a synthesis method of those polymers usable in the invention include synthesis methods utilizing polycondensation, addition polymerization, polyaddition, addition condensation, ring-opening polymerization or polymer reaction. In the invention, it is preferable to use the polymers synthesized by addition reaction. For example, the polymers obtained by addition polymerization (e.g., radical polymerization of a vinyl monomer having thioether linkage, or vinyl polymerization with the aid of a mercapto compound as a chain transfer agent) or polymer reaction (e.g., nucleophilic or radical addition reaction to polymer side chains having reactive groups) are preferably used in the invention.

Examples of those polymers suitably used in the invention are illustrated below.

P-1

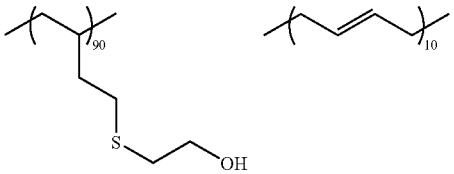

P-2

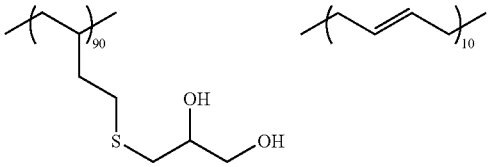

P-3

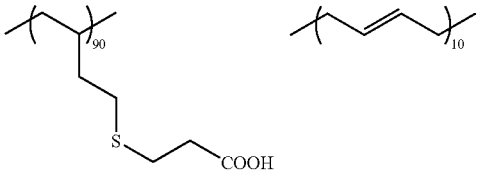

P-4

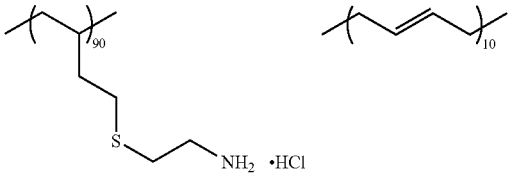

P-5

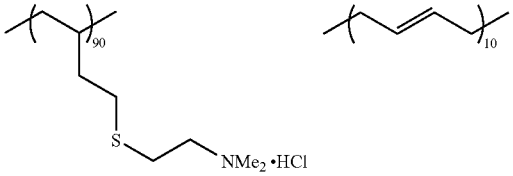

P-6

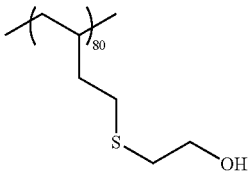

-continued

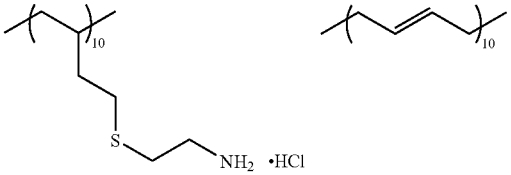

P-7

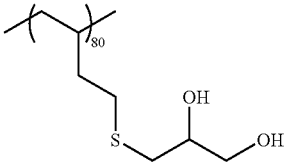

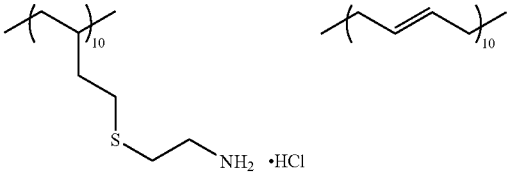

P-8

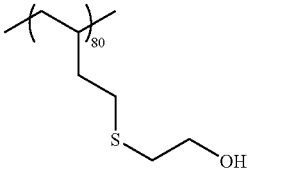

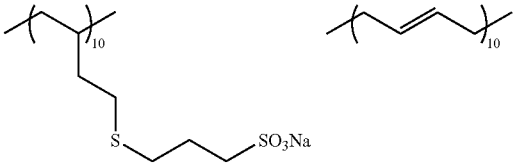

P-9

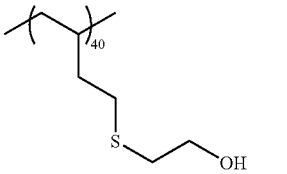

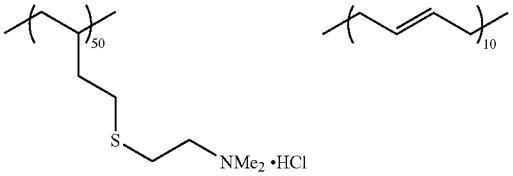

P-10

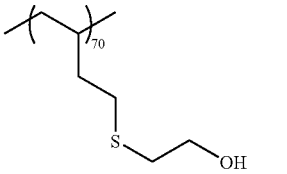

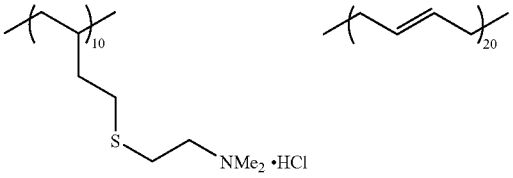

-continued

P-11

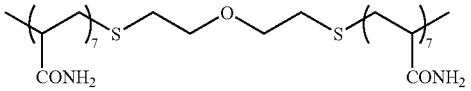

P-12

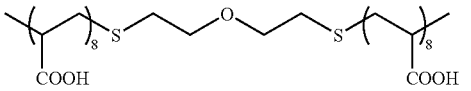

P-13

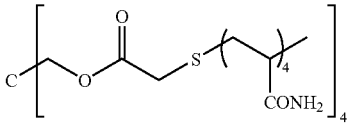

P-14

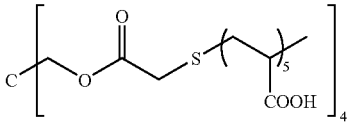

P-15

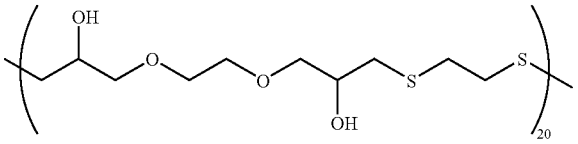

P-16

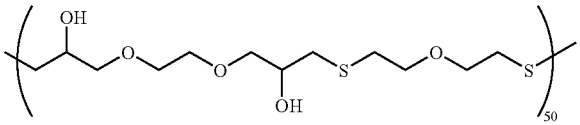

P-17

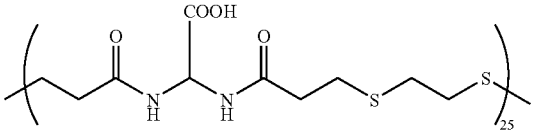

P-18

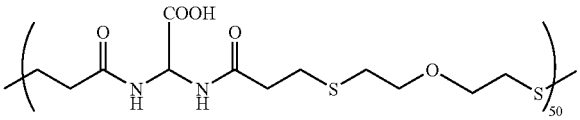

P-19

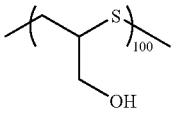

P-20

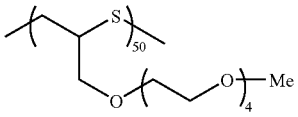

P-21

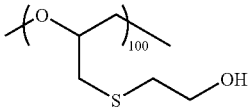

P-22

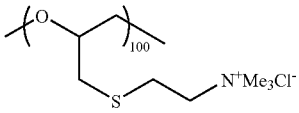

-continued

P-23

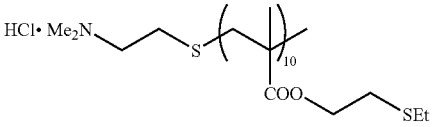

P-24

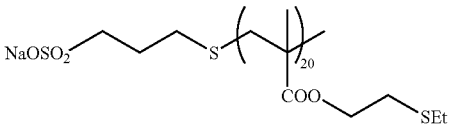

P-25

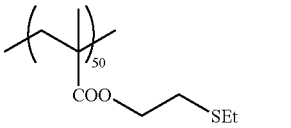

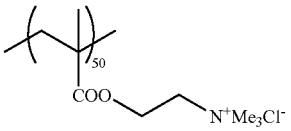

P-26

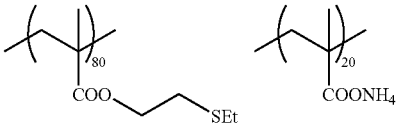

P-27

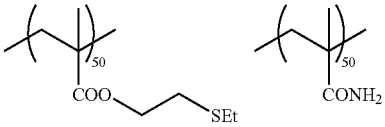

In view of application to a substrate, it is preferable that the polymers usable in the invention have solubility in water or a water-miscible organic solvent. However, the polymers capable of taking the form of water-dispersed latex can also be used in the invention. Therefore, there is no particular restriction on the polymer solubility.

Of the sulfur compounds recited above, the thioether compounds and the sulfoxide compounds are preferred over the others.

(Inorganic Fine Particles)

The ink-receiving layer in the invention contains at least one kind of inorganic fine particles.

The inorganic fine particles have a function of enhancing absorption of ink by creating a porous structure when the ink-receiving layer is formed.

It is especially advantageous that the solid content of the inorganic fine particles in the ink-receiving layer is 50% or more by mass, preferably higher than 60% by mass, because it becomes possible to create a better porous structure, and to contribute to formation of an inkjet recording medium with sufficient ink absorbency. Herein, the expression "solid content" of fine particles in the ink-receiving layer refers to the content calculated on the basis of all ingredients except water in the composition for the ink-receiving layer.

Examples of inorganic fine particles for use in the invention include silica fine particles, colloidal silica, titanium dioxide, barium sulfate, calcium silicate, zeolite, kolinite, hollysite, mica, talc, calcium carbonate, magnesium carbonate, calcium sulfate, pseudo-boehmite, zinc oxide, zinc hydroxide, alumina, aluminum silicate, calcium silicate, magnesium silicate, zirconium oxide, zirconium hydroxide, cerium oxide, lanthanum oxide and yttrium oxide. Of these substances, silica fine particles, colloidal silica, alumina fine particles and pseudo-boehmite are preferred over the others from the viewpoint of creating good porous structure. These fine particles may be used as they are primary particles, or in a state that they are formed into secondary particles. The average primary particle diameter of these fine particles is preferably 2 μm or less, far preferably 200 nm or less.

Moreover, silica fine particles having an average primary particle diameter of 30 nm or less, colloidal silica having an average primary particle diameter of 30 nm or less, alumina fine particles having an average primary particle diameter of 20 nm or less and pseudo-boehmite having an average pore radius of 2 to 15 nm are preferable by far, and silica fine particles, alumina fine particles and pseudo-boehmite in particular are used to advantage.

Silica fine particles are usually roughly classified into wet method particles and dry method (vapor phase process) particles in accordance with the method for manufacturing thereof. In the mainstream of the wet method, silica fine particles are mainly produced by generating an activated silica by acid decomposition of a silicate, appropriately polymerizing the activated silica, and aggregation precipitation of the resulting polymeric silica to obtain hydrated silica. On the other hand, in the mainstream of the gas phase process, silica (anhydrous silica) particles are produced by either a method having high-temperature gas-phase hydrolysis of a silicon halide (flame hydrolysis process), or a method having reductively heating and vaporizing quartz and coke in an electric furnace, applying an arc discharge and oxidizing the vaporized silica with air (arc method). The "vapor-phase process silica" means a silica (an anhydrous silica fine particle) produced by the gas phase process. Vapor-phase process silica fine particles are particularly preferable as the silica fine particles used in the invention.

While the above vapor-phase process silica differs from hydrated silica in terms of the density of silanol groups on its surfaces, the presence or not of voids therein, and the like, and different properties are exhibited from each other, vapor-phase process silica is suitable for forming three-dimensional structures which have a high void ratio. While the reason for this is not clearly understood, it can be supposed as follows. Namely, hydrated silica fine particles have a high density of silanol groups on the surface, at 5 to 8 per $nm^2$, thus the silica fine particles tend to coagulate (aggregate) densely. In contrast, vapor-phase-process silica particles have a lower density of silanol groups on the surface, at 2 to 3 per $nm^2$, thus vapor-phase process silica seems to form less compact, loose coagulations (flocculations), consequently leading to structures with a higher void ratio.

The vapor-phase process silica has high ink absorbency and retention efficiency because of its particularly large specific surface, and a low refractive index too. Therefore, the vapor-phase process silica has features that it can impart transparency to the ink-receiving layer and ensure high color densities and good color forming capabilities as long as dispersion thereof is performed until it comes to have appropriate particle diameters. It is important for the ink-receiving layer to be transparent from the viewpoint of ensuring high color densities and good developed-color gloss in not only transparency-required uses, such as OHP, but also applications to recording media such as gloss photo paper.

An average primary particle diameter of the vapor-phase process silica particles is preferably 30 nm or less, more preferably 20 nm or less, particularly preferably 10 nm or less, and the most preferably in a range of 3 to 10 nm. Since the vapor-phase process silica particles easily adhere to each other by hydrogen bonds due to the silanol groups, a structure having a high porosity can be formed thereby when the average primary particle size is 30 nm or less, whereby the ink absorption characteristic can be effectively improved. The silica fine particles may be used in combination with other fine particles described above. When the other fine particles are used in combination with the vapor-phase silica, the amount of the vapor-phase silica relative to the total amount of fine particles is preferably 30% or more by mass, and more preferably 50% or more by mass.

Preferable examples of inorganic fine particles which can be additionally used in the invention include alumina fine particles, alumina hydrate, and mixtures or complexes thereof. Among them, alumina hydrate is further preferable, as it absorbs and holds inks well. Pseudo-boemite ($Al_2O_3.nH_2O$) is particularly preferable. Alumina hydrate may be used in a variety of forms. Alumina hydrate is preferably prepared by using boehmite in the sol state as the starting material, as it easily provides smoother layers.

An average pore radius of pseudo-boemite is preferably in a range of 1 to 30 nm and more preferably in a range of 2 to 15 nm. The pore volume thereof is preferably in a range of 0.3 to 2.0 mg/g, and more preferably in a range of 0.5 to 1.5 mg/g. The average pore radius and the pore volume are determined by the nitrogen absorption-desorption method. These values may be determined, for example, by using a gas absorption-desorption analyzer (e.g., trade name: OMNISORP 369, manufactured by Beckman Coulter, Inc.).

Of the alumina fine particles, the vapor-phase process alumina fine particles are preferred because of large specific surface. The average primary particle diameter of the vapor-phase process alumina is preferably 30 nm or less, far preferably 20 nm or less.

In application of the fine particles as recited above to an inkjet recording medium, each of the aspects disclosed in JP-A Nos. 10-81064, 10-119423, 10-157277, 10-217601 and 11-348409, JP-A Nos. 2001-138621, 2000-43401, 2000-211235, 2000-309157, 2001-96897 and 2001-138627, JP-A Nos. 11-91242, 8-2087, 8-2090, 8-2091, 8-2093, 8-174992 and 11-192777, and JP-A No. 2001-301314 can be utilized as one embodiment of the present invention.

(Water-Soluble Resin)

The ink-receiving layer in the invention preferably contains at least one kind of water-soluble resin.

Examples of the water-soluble resin include resins having hydroxyl groups as hydrophilic structural units, such as polyvinyl alcohol resins (e.g., polyvinyl alcohol (PVA), acetoacetyl-modified polyvinyl alcohol, cation-modified polyvinyl alcohol, anion-modified polyvinyl alcohol, silanol-modified polyvinyl alcohol, polyvinyl acetal), cellulose resins (e.g., methyl cellulose (MC), ethyl cellulose (EC), hydroxyethyl cellulose (HEC), carboxymethyl cellulose (CMC), hydroxypropyl cellulose (HPC), hydroxyethylmethyl cellulose, hydroxypropylmethyl cellulose), chitins, chitosans and starch; resins having ether links (e.g., polyethylene oxide (PEO), polypropylene oxide (PPO), polyethylene glycol (PEG), polyvinyl ether (PVE)); and resins having carbamoyl groups (e.g., polyacrylamide (PAAM), polyvinyl pyrrolidone (PVP), polyacrylic acid hydrazide).

In addition, the water-soluble resins may be resins having carboxyl groups as dissociative groups, with examples including polyacrylic acid salts, maleic acid resins, alginates and gelatins.

Of those resins, at least one kind of resin selected from polyvinyl alcohol resins, cellulose resins, resins having ether links, resins having carbamoyl groups, resins having carboxyl groups or gelatins, notably polyvinyl alcohol (PVA) resins, is preferred as the water-soluble resin used in the invention.

Examples of the polyvinyl alcohol resins include the substances disclosed in JP-B No. 4-52786, JP-B No. 5-67432, JP-B No. 7-29479, Japanese Patent No. 2537827, JP-B No. 7-57553, Japanese Patent No. 2502998, Japanese Patent No. 3053231, JP-A No. 63-176173, Japanese Patent No. 2604367, JP-A No. 7-276787, JP-A No. 9-207425, JP-A No. 11-58941, JP-A No. 2000-135858, JP-A No. 2001-205924, JP-A No. 2001-287444, JP-A No. 62-278080, JP-A No. 9-39373, Japanese Patent No. 2750433, JP-A No. 2000-158801, JP-A No. 2001-213045, JP-A No. 2001-328345, JP-A No. 8-324105, JP-A No. 11-348417, JP-A No. 58-181687, JP-A No. 10-259213, JP-A No. 2001-72711, JP-A No. 2002-103805, JP-A No. 2000-63427, JP-A No. 2002-308928, JP-A No. 2001-205919 and JP-A No. 2002-264489.

In addition, examples of water-soluble resins other than the polyvinyl alcohol resins include the compounds disclosed in JP-A No. 11-165461, paragraphs [0011] and [0012], and the compounds disclosed in JP-A No. 2001-205919 and JP-A No. 2002-264489.

Those water-soluble resins may be used alone or as combinations of two or more thereof. The water-soluble resin content in the invention is preferably from 9% to 40% by mass, far preferably from 12% to 33% by mass, based on the total solids in the ink-receiving layer.

In the invention, each of the water-soluble resin and the inorganic fine particles, which are main ingredients of the ink-receiving layer, may be a single material or a mixture of multiple materials.

Additionally, the kind of a water-soluble resin used in concert with inorganic fine particles, notably silica fine particles, becomes important from the viewpoint of transparency retention. When the vapor-phase process silica is used, the water-soluble resin used in combination is preferably a polyvinyl alcohol resin, far preferably a polyvinyl alcohol resin having a saponification degree of 70 to 100%, particularly preferably a polyvinyl alcohol resin having a saponification degree of 80 to 99.5%.

The polyvinyl alcohol resins have hydroxyl groups in their respective structural units, and hydrogen bonds are formed between these hydroxyl groups and silanol groups present on the surfaces of silica fine particles; as a result, it becomes easy to form a three-dimensional network structure having secondary particles of silica fine particles as network chain units. It is thought that formation of such a three-dimensional network structure allows the ink-receiving layer formed to have a porous structure of a high porosity and sufficient strength.

When inkjet recording is performed, the porous ink-receiving layer formed in the foregoing manner can quickly absorb ink through capillary action and form dots of a high circularity without developing ink bleed.

The polyvinyl alcohol resin may be used in combination with other water-soluble resins. In a case where other water-soluble resin is used in combination with the polyvinyl alcohol resin, a content of the polyvinyl alcohol resin is preferably 50% by mass or more, and more preferably 70% by mass or more relative to a total mass of water-soluble resins used in the ink-receiving layer.

Ratio of Inorganic Fine Particle Content to Water-Soluble Resin Content

By optimizing a ratio of an inorganic fine particle content (x) by mass to a water-soluble resin content (y) by mass [PB ratio (x/y)], film structure and film strength of the ink-receiving layer can further be improved.

The mass content ratio [PB ratio (x/y)] in the ink-receiving layer is preferably in a range of 1.5 to 10 from viewpoints of preventing a decrease of the film strength and an appearance of cracks under drying, which are caused by excessively high PB ratios, and avoiding reduction in ink absorption by a porosity decrease resulting from a tendency to clog pores with the resins, which develops when PB ratios are excessively low.

At the time of passage through the feeding system of an inkjet printer, the recording medium is subjected to stress in some cases, so the ink-receiving layer is required to have sufficient film strength. In addition, from the standpoint of avoiding occurrence of cracking and exfoliation in the ink-receiving layer at a time when the recording medium is cut into sheets, sufficient film strength becomes necessary for the ink-receiving layer. In view of these cases, the mass ratio (x/y) is preferably 5 or less, while it is preferably 2 or more from the viewpoint of ensuring quick ink absorption in inkjet printing.

For example, when a coating liquid prepared by completely dispersing vapor-phase process silica fine particles having an average primary particle diameter of 20 nm or less and a water-soluble resin at a mass ratio (x/y) of 2 to 5 is applied onto a support and dried, a three-dimensional network is formed having secondary particles of the silica fine particles as network chains, whereby a translucent porous film having 30 nm or less average pore diameter, 50 to 80% porosity, 0.5 ml/g or more specific pore volume, and 100 $m^2/g$ or more specific surface area can be easily formed. (Magnesium Salt)

From the viewpoint of further enhancing ozone resistance, it is preferable that the ink-receiving layer in the invention further contains at least one kind of magnesium salt.

Examples of such a magnesium salt include magnesium acetate, magnesium oxalate, magnesium sulfate, magnesium chloride hexahydrate, and magnesium citrate nonahydrate. Of these salts, magnesium chloride hexahydrate is preferred over the others.

Examples of a commercially available magnesium salt include WHITE NIGARI NS and ENKA MAG (TOKUGO) NS (trade names, products of Naikai Salt Industries Co., Ltd.).

From the viewpoint of more effectively achieving the effects of the invention, the magnesium-salt content in the ink-receiving layer is preferably from 0.05% to 5% by mass, far preferably from 0.1% to 3% by mass, particularly preferably from 0.2% to 2% by mass.

(Colloidal Silica)

When the ink-receiving layer in the invention has a colloidal silica layer as the uppermost layer, the average primary particle diameter of colloidal silica used is preferably from 10 nm to 200 nm, far preferably from 50 nm to 150 nm.

The colloidal silica preferably used in the invention is either anionic or nonionic. And anionic colloidal silica in particular is preferable. The colloidal silica content is preferably from 0.01 $g/m^2$ to 5 $g/m^2$, particularly preferably from 0.05 $g/m^2$ to 2 $g/m^2$.

(Crosslinking Agent)

From the viewpoint of crosslinking the water-soluble resin, it is preferable that the ink-receiving layer in the invention contains at least one kind of crosslinking agent.

In one embodiment of the present invention, a porous layer formed specially by using the foregoing combination of inorganic fine particles and water-soluble resin and hardening the water-soluble resin by crosslinking reaction with a crosslinking agent is adopted as the ink-receiving layer in the invention.

For crosslinking of the water-soluble resins, notably polyvinyl alcohol, boron compounds are suitably used.

Examples of such boron compounds include borax, boric acid, borates (such as orthoborate, $InBO_3$, $ScBO_3$, $YBO_3$, $LaBO_3$, $Mg_3(BO_3)_2$ and $Co_3(BO_3)_2$), diborates (such as $Mg_2B_2O_5$ and $Co_2B_2O_5$), metaborates (such as $LiBO_2$, $Ca(BO_2)_2$, $NaBO_2$ and $KBO_2$), tetraborates (such as $Na_2B_4O_7.10H_2O$), and pentaborates (such as $KB_5O_8.4H_2O$, $Ca_2B_6O_{11}.7H_2O$ and $CsB_5O_5$). Of these boron compounds, borax, boric acid and borates, especially boric acid, are used to advantage in point of quick induction of crosslinking reaction.

As crosslinking agents for the water-soluble resins, the following compounds other than the boron compounds can also be used.

Specifically, the compounds usable as the crosslinking agents include aldehyde compounds, such as formaldehyde, glyoxal and gurtaraldehyde; ketone compounds, such as diacetyl and cyclopentanedione; active halogen compounds, such as bis(2-chloroethylurea)-2-hydroxy-4,6-dichloro-1,3,5-triazine and sodium 2,4-dichloro-6-s-triazine; active vinyl compounds, such as divinylsulfonic acid, 1,3-vinylsulfonyl-2-propanol, N,N'-ethylenebis(vinylsulfonylacetamide) and 1,3,5-triacryloyl-hexahydro-s-triazine; N-methylol compounds, such as dimethylolurea and methyloldimethylhydantoin; melamine resins, such as methylolmelamine and alkylated methylolmelamine; epoxy resins;

isocyanate compounds, such as 1,6-hexamethylene diisocyanate; the aziridine compounds disclosed in U.S. Pat. Nos. 3,017,280 and 2,983,611; the carboxyimide compounds disclosed in U.S. Pat. No. 3,100,704; epoxy compounds, such as glycerol triglycidyl ether; ethyleneimino compounds, such as 1,6-hexamethylene-N,N'-bisethyleneurea; halogenated carboxyaldehyde compounds, such as mucochloric acid and mucophenoxychloric acid; dioxane compounds, such as 2,3-dihydroxydioxane; metal-containing compounds, such as titanium lactate, aluminum sulfate, chrome alum, potassium alum, zirconyl acetate and chromium acetate; polyamine compounds, such as tetraethylenepentamine; hydrazide compounds, such as adipic dihydrazide; and low-molecular and high-molecular compounds each having at least two oxazoline groups.

The crosslinking agents as recited above can be used alone or as combinations of any two or more thereof.

The amount of crosslinking agent(s) used is preferably from 1% to 50% by mass, far preferably from 5% to 40% by mass, based on the water-soluble resin.

(Water-Soluble Polyvalent Metal Salt)

Besides containing the magnesium salt as recited above, the ink-receiving layer in the invention preferably contains at least one kind of water-soluble polyvalent metal compound as a mordant.

As water-soluble polyvalent metal compounds, trivalent or higher metal compounds are preferably used in the invention. Further, such polyvalent metal compounds may be water-soluble salts of metals chosen from calcium, barium, manganese, copper, cobalt, nickel, aluminum, iron, zinc, zirconium, chromium, tungsten or molybdenum.

Examples of those metal compounds include calcium acetate, calcium chloride, calcium formate, calcium sulfate, calcium butyrate, barium acetate, barium sulfate, barium phosphate, barium oxalate, barium naphtoresorcincarboxylate, barium butyrate, manganese chloride, manganese acetate, manganese formate dihydrate, ammonium manganese sulfate hexahydrate, cupric chloride, ammonium copper (II) chloride dihydrate, copper sulfate, copper(II) butyrate, copper oxalate, copper phthalate, copper citrate, copper gluconate, copper naphthenate, cobalt chloride, cobalt thiocyanate, cobalt sulfate, cobalt(II) acetate, cobalt naphthenate, nickel sulfate hexahydrate, nickel chloride hexahydrate, nickel acetate tetrahydrate, ammonium nickel sulfate hexahydrate, nickel amidosulfate tetrahydrate, nickel sulfamidate, nickel 2-ethylhexanoate, aluminum sulfate, aluminum sulfite, aluminum thiosulfate, polyaluminum chloride, aluminum nitrate nonahydrate, aluminum chloride hexahydrate, aluminum acetate, aluminum lactate, basic aluminum thioglycolate, ferrous bromide, ferrous chloride, ferric chloride, ferrous sulfate, ferric sulfate, iron(III) citrate, iron(III) lactate trihydrate, triammonium iron(III) trioxalate trihydrate, zinc bromide, zinc chloride, zinc nitrate hexahydrate, zinc sulfate, zinc acetate, zinc lactate, zirconium acetate, zirconium tetrachloride, zirconium chloride, zirconium oxychloride octahydrate, zirconium hydroxychloride, chromium acetate, chromium sulfate, sodium phosphotungstate, sodium tungsten citrate, phospho-12-tungstic acid n-hydrate, 12-silicotungstic acid hexacosahydrate, molybdenum chloride, phospho-12-molybdic acid n-hydrate, aluminum alum, basic polyaluminum hydroxide, zinc phenolsulfonate, ammonium zinc acetate, and ammonium zinc carbonate. These water-soluble polyvalent metal compounds may be used as combinations of any two or more thereof. In the invention, the word "water-soluble" in the term water-soluble polyvalent metal compound means that the polyvalent metal compound can be dissolved in 20° C. water in a concentration of 1% or more by mass.

Of those water-soluble polyvalent metal compounds, aluminum compounds or compounds containing the group IVA metals in the periodic table (e.g., zirconium, titanium) are preferred over the others, and aluminum compounds are preferable by far. Water-soluble aluminum compounds in particular are favorable. As the water-soluble aluminum compounds, inorganic salts, such as aluminum chloride or hydrates thereof, aluminum sulfate or hydrates thereof, and aluminum alum, are known. In addition to these salts, basic polyaluminum hydroxide compounds as inorganic aluminum-containing cationic polymers (hereafter referred to as basic polyaluminum chloride or polyaluminum chloride too) are also known, and can be used to advantage.

The term "basic polyaluminum hydroxide compounds" described above refers to the water-soluble polyaluminum hydroxides whose main components are represented by the following formula 1, 2 or 3, and wherein basic polymeric polynuclear condensed ions, such as $[Al_6((O)H)_{15}]^{3+}$, $[Al_8(OH)_{20}]^{4+}$, $[Al_{13}(OH)_{34}]^{5+}$ and $[Al_{21}(OH)_{60}]^{3+}$, are contained with stability.

$$[Al_2(OH)_nCl_{6-n}]_m \quad \text{Formula 1}$$

$$[Al(OH)_3]_nAlCl_3 \quad \text{Formula 2}$$

$$Al_n(OH)_mCl_{(3n-m)}, 0<m<3n \quad \text{Formula 3}$$

Such basic polyaluminum hydroxide compounds are available from TAKI CHEMICAL CO., LTD. as a water treatment chemical under the trade name of Polyaluminum Chloride (PAC), Asada Chemical Industry Co., Ltd. under the trade name of Polyaluminum Hydroxide (Paho), rikengreen Co., Ltd. under the trade name of HAP-25, TAIMEI Chemicals Co., Ltd. under the trade name of ALFINE 83, or other makers as products developed with intentions similar to the above, and it is easy to get their products in various grades.

As the water-soluble compounds containing the group IVA elements in the periodic table, titanium- and zirconium-containing water-soluble compounds are preferred. Examples of a titanium-containing water-soluble compound include titanium chloride, titanium sulfate, titanium tetrachloride, tetraisopropyl titanate, titanium acetylacetonate, and titanium lactate. Examples of a zirconium-containing water-soluble compound include zirconium acetate, zirconium chloride, zirconium hydroxychloride, zirconium nitrate, basic zirconium carbonate, zirconium hydroxide, zirconium lactate, ammonium zirconium carbonate, potassium zirconium carbonate, zirconium sulfate, and zirconium fluoride compounds.

The proportion of water-soluble polyvalent metal compounds added is preferably from 0.1 to 10% by mass, far preferably from 0.5 to 8% by mass, based on the inorganic fine particles.

(Organic Nitrogen-Containing Cationic Polymer)

In addition, from the viewpoint of inhibiting bleeding of recorded images, the ink-receiving layer may contain at least one kind of organic nitrogen-containing cationic polymer.

The organic nitrogen-containing cationic polymer usable in the invention has no particular restriction, but polymers having primary, secondary or tertiary amino groups, or polymers having quaternary ammonium salt groups are favorable for use.

Such organic nitrogen-containing cationic polymers include a homopolymer of a monomer having a primary, secondary or tertiary amino group, or a salt thereof, or a monomer having a quaternary ammonium salt group (an organic nitrogen-containing cationic monomer), and a copolymer or condensate of the organic nitrogen-containing cationic monomer as recited above and another monomer. And these organic nitrogen-containing cationic polymers can be used in both the form of water-soluble polymer and the form of water-dispersible latex particles.

Examples of the organic nitrogen-containing cationic monomer include trimethyl-p-vinylbenzylammonium chloride, trimethyl-m-vinylbenzylammonium chloride, triethyl-p-vinylbenzylammonium chloride, triethyl-m-vinylbenzylammonium chloride, N,N-dimethyl-N-ethyl-N-p-vinylbenzylammonium chloride, N,N-diethyl-N-methyl-N-p-vinylbenzylammonium chloride, N,N-dimethyl-N-n-propyl-N-p-vinylbenzylammonium chloride, N,N-dimethyl-N-n-octyl-N-p-vinylbenzylammonium chloride, N,N-dimethyl-N-benzyl-N-p-vinylbenzylammonium chloride, N,N-diethyl-N-benzyl-N-p-vinylbenzylammonium chloride, N,N-dimethyl-N-(4-methyl)benzyl-N-p-vinylbenzylammonium chloride, N,N-dimethyl-N-phenyl-N-p-vinylbenzylammonium chloride, trimethyl-p-vinylbenzylammonium bromide, trimethyl-m-vinylbenzylammonium bromide, trimethyl-p-vinylbenzylammonium sulfonate, trimethyl-m-vinylbenzylammonium sulfonate, trimethyl-p-vinylbenzylammonium acetate, trimethyl-m-vinylbenzylammonium acetate, N,N,N-triethyl-N-2-(4-vinylphenyl)ethylammonium chloride, N,N,N-triethyl-N-2-(3-vinylphenyl)ethylammonium chloride, N,N-diethyl-N-methyl-N-2-(4-vinylphenyl)ethylammonium chloride, N,N-diethyl-N-methyl-N-2-(4-vinylphenyl)ethylammonium acetate, quaternarized products prepared by reacting N,N-dimethylaminoethyl(meth)acrylate, N,N-diethylaminoethyl (meth)acrylate, N,N-dimethylaminopropyl(meth)acrylate, N,N-diethylaminopropyl(meth)acrylate, N,N-dimethylaminoethyl(meth)acrylamide, N,N-diethylaminoethyl(meth) acrylamide, N,N-dimethylaminopropyl(meth)acrylamide or N,N-diethylaminopropyl(meth)acrylamide with methyl chloride, ethyl chloride, methyl bromide, ethyl bromide, methyl iodide or ethyl iodide, and sulfonates, alkylsulfonates, acetates or alkylcarboxylates obtained by anion substitution of those quaternarized products.

Examples of such products include monomethyldiallylammonium chloride, trimethyl-2-(methacryloyloxy)ethylammonium chloride, triethyl-2-(methacryloyloxy)ethylammonium chloride, trimethyl-2-(acryloyloxy)ethylammonium chloride, triethyl-2-(acryloyloxy)ethylammonium chloride, trimethyl-3-(methacryloyloxy)propylammonium chloride, triethyl-3-(methacryloyloxy)propylammonium chloride, trimethyl-2-(methacryloylamino)ethylammonium chloride, triethyl-2-(methacryloylamino)ethylammonium chloride, trimethyl-2-(acryloylamino)ethylammonium chloride, triethyl-2-(acryloylamino)ethylammonium chloride, trimethyl-3-(methacryloylamino)propylammonium chloride, triethyl-3-(methacryloylamino)propylammonium chloride, trimethyl-3-(acryloylamino)propylammonium chloride, triethyl-3-(acryloylamino)propylammonium chloride, N,N-dimethyl-N-ethyl-2-(methacryloyloxy)ethylammonium chloride, N,N-diethyl-N-methyl-2-(methacryloyloxy)ethylammonium chloride, N,N-dimethyl-N-ethyl-3-(acryloylamino) propylammonium chloride, triethyl-2-(methacryloyloxy) ethylammonium bromide, trimethyl-3-(acryloylamino) propylammonium bromide, trimethyl-2-(methacryloylamino)ethylammonium sulfonate and trimethyl-3-(acryloylamino)propylammonium acetate. In addition to the monomers recited above, N-vinylimidazole and N-vinyl-2-methylimidazole can be used as monomers copolymerizable with those monomers. Additionally, it is also possible to utilize polymers having vinylamine units converted from their original polymerizing units, such as N-vinylacetamide and N-vinylformamide, by hydrolysis after polymerization, and the polymers having salt-form units converted from their vinylamine units.

As other monomers copolymerizable (polycondensatable) with the organic nitrogen-containing cationic monomers as recited above, monomers having neither basic nor cationic moieties, such as primary, secondary and tertiary amino groups, their salts, or quaternary ammonium bases, and showing no or substantially weak interaction with dyes in inkjet ink can be used. Examples of such comonomers include alkyl esters of (meth)acrylic acid; cycloalkyl esters of (meth) acrylic acid, such as cyclohexyl(meth)acrylate; aryl esters of (meth)acrylic acid, such as phenyl(meth)acrylate; aralkyl esters, such as benzyl(meth)acrylate; aromatic vinyl compounds, such as styrene, vinyltoluene and α-methylstyrene; vinyl esters, such as vinyl acetate, vinyl propionate and vinyl versatate; allyl esters, such as allyl acetate; halogen-containing monomers, such as vinylidene chloride and vinyl chloride; vinyl cyanides, such as (meth)acrylonitrile; and olefins, such as ethylene and propylene.

The alkyl esters of (meth)acrylic acid are preferably those which contain 1 to 18 carbon atoms in their respective alkyl moieties, with examples including methyl(meth)acrylate, ethyl (meth)acrylate, propyl(meth)acrylate, isopropyl(meth) acrylate, n-butyl(meth)acrylate, isobutyl (meth)acrylate, t-butyl(meth)acrylate, hexyl(meth)acrylate, octyl(meth) acrylate, 2-ethylhexyl (meth)acrylate, lauryl(meth)acrylate and stearyl(meth)acrylate. Of these (meth)acrylates, methyl acrylate, ethyl acrylate, methyl methacrylate, ethyl methacrylate and hydroxyethyl methacrylate are preferred over the others. These comonomers also can be used alone or as combinations of two or more thereof.

Of the organic nitrogen-containing cationic polymers recited above, cationic polyurethanes and the cationic polymers disclosed in JP-A No. 2004-167784 are preferred over the others from the viewpoint of bleeding control, and cationic polyurethanes are preferable by far.

Examples of commercially available products of cationic polyurethanes include SUPERFLEX 650, F-8564D and F-8570D (trade names, products of DAI-ICHI KOGYO SEIYAKU CO., LTD.), and NEOFIX IJ-150 (trade name, a product of NICCA CHEMICAL CO., LTD.).

From the viewpoint of dispersibility of silica, poly(diallyldimethylammonium chloride) and derivatives of poly (methacryloyloxyethyl-β-hydroxyethyldimethylammonium chloride) are preferable, and poly(diallyldimethylammonium chloride) is preferable by far.

One example of commercially available products of such polymers is CHEMISTAT 7005 (trade name, a product of Sanyo Chemical Industries, Ltd.).

In addition, it is also preferable that the organic nitrogen-containing cationic polymer is a polymer prepared from a cationic emulsion described hereafter.

(Other Ingredients)

The ink-receiving layer in the invention may further contain other ingredients including mordants other than the organic nitrogen-containing cationic polymers, magnesium salts and water-soluble polyvalent metal salts as recited above, and various types of surfactants.

As the other ingredients, those chosen appropriately from the ingredients disclosed in JP-A No. 2005-14593, paragraphs [0088] to [0117], and JP-A No. 2006-321176, paragraphs [0138] to [0155], can be used.

<Substrate>

As the substrate in the invention, both a transparent substrate made from a transparent material such as plastic and an opaque substrate made from an opaque material such as paper can be used. In order to exploit the transparency of the ink-receiving layer, the use of a transparent substrate or a high-gloss opaque substrate is advantageous. Alternatively, it is possible to use as the substrate a read-only optical disc, such as CD-ROM or DVD-ROM, a write-once optical disc, such as DC-R or DVD-R, or a rewritable optical disc, and provide the ink-receiving layer on the label side of such a disc.

A transparent material resistant to radiant heat applied thereto when the medium is used on an OHP or back light display is preferable as the material for the transparent substrate. Examples of the material include polyesters such as polyethylene terephthalate (PET), polysulfone, polyphenylene oxide, polyimide, polycarbonate, polyamide and the like. Among them, polyesters are preferable, and polyethylene terephthalate is particularly preferable.

The thickness of the transparent substrate has no particular limits, but it is preferably from 50 to 200 μm in point of easy handling.

The high-gloss opaque substrate preferably has a glossiness of 40% or more on the surface where the ink-receiving layer is formed. The glossiness is a value determined by a known method taught by ISO 8254-1, i.e., Paper and board—Measurement of specular gloss—Part 1: 75 degree gloss with a converging beam. Specific examples of the substrates include the following:

Specific examples of the high-gloss opaque substrate include: high-gloss paper substrates such as art paper, coated paper, cast-coated paper, baryta paper commonly used as a silver salt photographic substrate and the like; high-gloss films opacified by adding a white pigment or the like to any one of plastic films such as polyesters such as polyethylene terephthalate (PET), nitrocellulose, cellulose acetate, cellulose esters such as cellulose acetate butylate, polysulfone, polyphenylene oxide, polyimide, polycarbonate, polyamide or the like (which may be additionally surface calendered); substrates having a polyolefin coating layer containing or not containing a white pigment formed on the surface of these various paper and transparent substrates or the high-gloss films containing a white pigment; or the like.

Foamed polyester films containing a white pigment (e.g., a foamed polyester formed by expanding a polyolefin microparticle-containing PET film so as to forming voids therein) are favorable and also included as examples. In addition, resin coated papers commonly used as photographic papers for silver salt photographs are also preferable.

While the thickness of the opaque substrate is not particularly limited, it is preferably in a range of 50 to 300 μm from the viewpoint of ease of handling.

The surface of substrate may be subjected to corona discharge treatment, glow discharge treatment, flame treatment, ultraviolet ray irradiation treatment or the like for improvement in wetting property and adhesiveness.

Then, base paper used in the resin-coated papers is described in detail.

The base paper is made by using wood pulp as a principal material and, as an additional material, synthetic pulp made from, e.g., polypropylene, or synthetic fiber, such as nylon fiber or polyester fiber, on an as needed basis. As the wood pulp, though any of LBKP, LBSP, NBKP, NBSP, LDP, NDP, LUKP and NUKP can be used, it is advantageous to use wood pulp rich in short fibers, such as LBKP, NBSP, LBSP, NDP or LDP, in a higher proportion.

However, the proportion of LBSP and/or LDP is preferably from 10% to 70% by mass.

Chemical pulps (such as sulfate salt pulp or sulfite pulp) containing a smaller amount of impurities are preferably used as the pulp used in the invention. Bleached pulps which are improved in whiteness are also useful.

Various additives including a sizing agent such as higher fatty acid or alkylketene dimer, a white pigment such as calcium carbonate, talc or titanium oxide, a paper-strength additive such as starch, polyacrylamide or polyvinyl alcohol, a fluorescent whitening agent, a moisturizing agent such as polyethylene glycols, a dispersing agent, a softener such as quaternary ammonium, and the like may be added to the base paper in accordance with necessity.

The freeness of the pulp for use in sheeting is preferably 200 to 500 ml as per CSF (Canadian Standard Freeness) regulations In regard to the fiber length after beating, the pulps remaining on 24- and 42-mesh screens is preferably 30 to 70% by mass, as determined by the known method taught by ISO 534, i.e., Paper and board—Determination of thickness and density. Further, the pulp remaining on 4-mesh screen is preferably 20% by mass or less.

The basis weight of base paper is preferably from 30 to 250 $g/m^2$, particularly preferably from 50 to 200 $g/m^2$. The thickness of base paper is preferably from 40 to 250 μm. It is also possible to impart high smoothness to base paper by performing calender treatment in a stage of papermaking or after papermaking. The base paper density is generally from 0.7 to 1.2 $g/m^3$ (JIS P-8118).

Furthermore, the stiffness of base paper is preferably from 20 to 200 g under conditions defined by JIS P-8143.

The base paper surface may be coated with a surface sizing agent, and the same sizing agent as added to the interior of base paper can also be used as the surface sizing agent.

The pH of base paper is preferably from 5 to 9 as measured according to the hydrothermal extraction method defined by JIS P-8113.

The polyethylene covering the front and rear surfaces of the base paper is mainly a low-density polyethylene (LDPE) and/or a high-density polyethylene (HDPE), but other LLDPE, polypropylene, or the like may also be used partially.

In particular, the polyethylene layer on which the ink-receiving layer is provided is preferably formed of polyethylenes containing rutile-titanium oxide, anatase-titanium oxide, a fluorescent whitening agent, and/or ultramarine that are improved in opacity, whiteness and hue, which are commonly used in photographic papers. The content of the titanium oxide is preferably in a range of about 3 to 20% and more preferably in a range of 4 to 13% by mass with respect to the polyethylene. The thickness of the polyethylene layer, either front or rear, is not particularly limited, but is favorably in a range of 10 to 50 μm. In addition, an undercoat layer may be formed on the polyethylene layer for increasing the adhesiveness thereof to an ink-receiving layer. Hydrophilic polyester, gelatin, and PVA are preferable for the undercoat layer. The thickness of the undercoat layer is preferably in a range of 0.01 to 5 μm.

The polyethylene-coated paper may be used as a glossy paper.

The polyethylene layer coated on the surface of the base paper by melt-extrusion may be further subjected to a surface modification treatment such as embossing so that it has a mat or silky surface similar to that of common photographic printing papers.

The substrate can also be provided with a backcoat layer, and to the backcoat layer white pigment, aqueous binder and other ingredients may be added.

Examples of white pigment which can be incorporated into the backcoat layer include inorganic white pigments, such as precipitated calcium carbonate, ground calcium carbonate, kaolin, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic amorphous silica, colloidal silica, colloidal alumina, pseudo-boehmite, aluminum hydroxide, alumina, lithopone, zeolite, hydrous halloysite, magnesium carbonate and magnesium hydroxide; and organic pigments, such as styrene-base plastic pigment, acrylic plastic pigment, polyethylene, microcapsules, urea resin and melamine resin.

Examples of the aqueous binders for use in the backcoat layer include water-soluble polymers such as styrene/maleic acid salt copolymers, styrene/acrylic salt copolymers, polyvinyl alcohol, silanol-modified polyvinyl alcohols, starch, cationic starch, casein, gelatin, carboxymethylcellulose, hydroxyethylcellulose, or polyvinylpyrrolidone; water-dispersible polymers such as styrene butadiene latexes or acryl emulsions; and the like.

The other components contained in the backcoat layer include defoaming agent, antifoaming agent, dye, fluorescent whitening agent, antiseptic, water-resistance imparting agent, and the like.

<Others>

In addition to the ink-receiving layer, the present inkjet recording medium may further have an ink solvent absorption layer, an interlayer and a protective layer. Furthermore, a subbing layer may also be provided on the substrate for the purposes of enhancing adhesion between the substrate and the ink-receiving layer and adjusting the electric resistance as appropriate.

To constituent layers (e.g., the ink-receiving layer and the backcoat layer) of the present inkjet recording medium, a fine-particle polymer dispersion may be added. This fine-particle polymer dispersion is used for the purpose of improving film properties, such as film's dimensional stability and anti-curl, anti-stick and anti-crack properties. Descriptions of the fine-particle polymer dispersion can be found, e.g., in JP-A No. 62-245258 and JP-A No. 10-228076 each. Addition of a dispersion of polymer fine particles with a low glass transition temperature (40° C. or below) to a layer containing a mordant as recited above allows the layer to be prevented from cracking and curling. Alternatively, prevention of curling can also be achieved by adding a dispersion of polymer fine particles with a high glass transition temperature to the backing layer.

Additionally, the ink-receiving layer, though may be provided on only one side of the substrate, may also be provided on both sides of the substrate with the intention of preventing deformation, such as curling. When the ink-receiving layer is provided on only one side of the substrate for a recording medium used in OHP or the like, an antireflection coating can also be provided on the opposite side or either side of the substrate for the purpose of enhancing optical transparency.

Further, by applying boric acid or a boron compound to the substrate surface on the side where the ink-receiving layer is to be provided, and thereon forming the ink-receiving layer, it also becomes possible to ensure glossiness and surface smoothness of the ink-receiving layer and inhibit printed-image bleeding with age in high-temperature and high-humidity environments.

<<Method of Manufacturing Inkjet Recording Medium>>

A first aspect of the method of manufacturing an inkjet recording medium according to the present invention is an aspect in which the method includes a process of forming a coating layer on a substrate by applying a first solution A containing at least inorganic fine particles and a sulfur compound and a first solution B differing from the first solution A in composition in this order from the substrate, and a process of performing cross-link curing of the coating layer by applying a second solution containing a basic compound at either (1) the same time as at least the first solution A and the first solution B are applied or (2) a stage in the course of drying of the coating layer formed by applying at least the first solution A and the first solution B, and that before the coating layer shows decreasing-rate drying, whereby forming an ink-receiving layer that includes the coating layer having undergone cross-link curing and contains the sulfur compound in a greater quantity in half at the near-substrate side than in half at the far-substrate side when the ink-receiving layer is divided into two equal parts by a plane parallel to the substrate.

Further a second aspect of the method of manufacturing an inkjet recording medium according to the present invention is an aspect in which the method includes a process of forming a coating layer on a substrate by applying to the substrate at least a first solution A containing inorganic fine particles and a sulfur compound and a first solution B differing from the first solution A in composition in this order from the substrate, a process of cooling the coating layer to a temperature at least 5° C. lower than lower one of temperatures at which the first solution A and the first solution B are applied, respectively, and a process of forming an ink-receiving layer by drying the coating layer cooled, and whereby the ink-receiving layer formed contains the sulfur compound in a greater quantity in half at the near-substrate side than in half at the far-substrate side when the ink-receiving layer is divided into two equal parts by a plane parallel to the substrate.

By configuring the method of manufacturing an inkjet recording medium according to the present invention as in the first aspect or the second aspect, the ink-receiving layer can be formed so as to contain the sulfur compound in a greater quantity in its lower half than in its upper half. As a result, it becomes possible to manufacture an inkjet recording medium which can keep high image density while improving ozone resistance of images recorded thereon.

In each of the first and second aspects, though the ink-receiving layer is formed by multilayer coating of plural coating solutions, the ink-receiving layer formed may have a multilayer structure which allows recognition of interfaces between the plural coating solutions, or a single-layer structure in which neither of interfaces between the plural coating solutions can be recognized.

<Process of Forming Coating Layer>

Each of the first and second aspects has a process of forming a coating layer on a substrate by applying a first solution A containing at least inorganic fine particles and a sulfur compound and a first solution B differing from the first solution A in composition in this order from the substrate (Hereinafter, this process is also referred to as the coating-layer formation process.)

In the coating-layer formation process, though it is required to apply to the substrate a plurality of solutions including at least the first solution A and the first solution B in the order of mention, a first solution C and other solutions may further be applied to the first solution B, if needed. In addition, a solution for barrier layer use (interlayer solution) may be laid between any adjacent two of the solutions applied.

The first solutions A and B (and besides, the first solution C and others as required) have no particular restriction as to the mode of their applications. In other words, those solutions may be formed into the coating layer in accordance with a simultaneous multilayer coating method hitherto known, or they may be formed into the coating layer on a one-by-one basis (by sequential application) in accordance with a heretofore-known method.

The simultaneous multilayer coating can be performed with known coating apparatus, such as an extrusion die coater and a curtain flow coater.

And the sequential coating can be performed with known coating apparatus, such as an extrusion die coater, an air doctor coater, a blade coater, a rod coater, a knife coater, a squeegee coater, a reverse roll coater and a bar coater.

Herein, the suitable quantity of each coating solution applied is described.

The application quantity of the first solution A on a wet basis is preferably from 50 to 200 ml/m$^2$, far preferably from 75 to 150 ml/m$^2$, while the application quantity of the first solution A on a solids basis is preferably from 5 to 25 g/m$^2$, far preferably from 10 to 18 g/m$^2$.

The application quantity of the first solution B on a wet basis is preferably from 50 to 200 ml/m$^2$, far preferably from 75 to 150 ml/m$^2$, while the application quantity of the first solution B on a solids basis is preferably from 5 to 25 g/m$^2$, far preferably from 10 to 18 g/m$^2$.

When the first solution C containing colloidal silica is used, the application quantity of the first solution C on a wet basis is preferably from 10 to 150 ml/m$^2$, far preferably from 20 to 100 ml/m$^2$, while the application quantity of the first solution C on a solids basis is preferably from 0.01 to 10 g/m$^2$, far preferably from 0.05 to 5 g/m$^2$.

The first solution A, the first solution B, and the first solution C used as required are described below.

(First Solution A)

The first solution A contains at least one kind of inorganic fine particles and at least one kind of sulfur compound.

Details of the inorganic fine particles and the sulfur compound are the same as described in the section <Ink-Receiving Layer>, and the preferred ranges of these constituents are also the same as specified respectively in that section.

In view of more effectively achieving effects of the invention, the sulfur compound content in the first solution A is preferably from 1 to 20% by mass, far preferably from 3 to 15% by mass, particularly preferably from 4 to 10% by mass, based on the total solids in the first solution A.

Additionally, the expression "the total solids in the first solution A" used in the invention refers to all ingredients but water in the first solution A. The meaning of the term "total solids" is ditto for other solutions.

The first solution A may further contain a water-soluble resin, a crosslinking agent, a dispersant, a water-soluble polyvalent metal salt, a mordant, a surfactant, and other ingredients.

When the first solution A is applied, it is also preferable that the first solution A is subjected to in-line mixing with a solution containing the water-soluble polyvalent metal salt as recited above (preferably a basic polyaluminum chloride), and then applied.

Details of various ingredients including the water-soluble resin, the crosslinking agent, the mordant, the surfactant and the water-soluble polyvalent metal compound are the same as described in the section <Ink-Receiving Layer>, and preferred forms of those ingredients are also the same as specified in that section. Dispersants which may be contained therein are described hereinafter.

The first solution A is preferably acidic, and the pH thereof is preferably 5.0 or below, far preferably 4.5 or below, further preferably 4.0 or below.

The first solution A can be adjusted to such a pH range by appropriately choosing the kind and amount of the cationic polymer (as a mordant and so on) added. Alternatively, the pH adjustment may be made by addition of an organic or inorganic acid. When the pH of the first solution A is 5.0 or below, crosslinking reaction of the water-soluble resin with a crosslinking agent (a boron compound in particular) in the first solution A can be adequately inhibited.

Preparation Method of First Solution A

In the invention, the first solution A containing at least inorganic fine particles and a sulfur compound can be prepared, e.g., as follows.

Specifically, vapor-phase process silica fine particles, a dispersant and a sulfur compound are added to water (so that the content of, e.g., silica fine particles in water is from 10 to 20% by mass), and subjected to a dispersing operation using a rapidly rotating wet colloidal mill (e.g., CLEARMIX, trade name, made by M TECHNIQUE) under conditions that the dispersion time is, e.g., 20 minutes (preferably from 10 to 30 minutes) and the revs are, e.g., as high as 10,000 rpm (preferably from 5,000 to 20,000 rpm). To the resulting dispersion, a crosslinking agent (e.g., boric acid) and an aqueous polyvinyl alcohol (PVA) solution (in such an amount that the PVA content becomes about one-third of the vapor-phase process silica content on a mass basis) are added, and further the water-soluble polyvalent metal salt (e.g., basic polyaluminum hydroxide) is added, and then the dispersion operation is carried out under the same rotational conditions as mentioned above, thereby preparing the first solution A.

Alternatively, the water-soluble polyvalent metal may be added by in-line mixing right before coating.

As another machine for the dispersing operations, a liquid-liquid collision dispersing machine (e.g., ULTIMIZER, trade name, made by Sugino Machine Ltd.) can also be used.

The coating solution obtained is in a homogeneous sol state, and this solution is applied to a substrate in accordance with the following application method, and then dried. Thus, a porous ink-receiving layer having a three-dimensional network structure can be formed.

The aqueous dispersion containing the vapor-phase process silica and a dispersant may be prepared by preparing in advance an aqueous dispersion of the vapor-phase process silica and then adding the aqueous dispersion to an aqueous dispersant solution or adding an aqueous dispersant solution to the aqueous dispersion of the vapor-phase process silica, or mixing them simultaneously. Alternatively, vapor-phase process silica powder, not the aqueous dispersion of vapor-phase process silica, may be directly added to an aqueous dispersant solution.

After mixing the vapor-phase process silica and the dispersant, the resulting mixture is subjected to fining of particles by use of a dispersing machine, and thereby an aqueous dispersion having an average particle size of 50 to 300 nm can be obtained. Examples of a dispersing machine usable for obtaining such an aqueous dispersion include various dispersing machines hitherto known, such as a rapidly rotating dispersing machine, a medium agitation-type dispersing machine (such as a ball mill or a sand mill), an ultrasonic dispersing machine, a colloid mill dispersing machine and a high-pressure dispersing machine. Of these dispersing machines, an agitation-type dispersing machine, a colloid mill dispersing machine and a high-pressure dispersing machine are preferred over the others form the viewpoint of effectively dispersing clotted fine grains.

In each of the foregoing steps, water, an organic solvent or a mixture thereof can be used as solvent. Examples of an organic solvent usable in the application include alcohol compounds such as methanol, ethanol, n-propanol, isopropanol and methoxypropanol, ketones such as acetone and methyl ethyl ketone, tetrahydrofuran, acetonitrile, ethyl acetate and toluene.

As the dispersant, a cationic polymer can be used. Examples of such a cationic polymer include the examples of mordants as disclosed in JP-A No. 2006-321176, paragraphs [0138] to [0148]. Alternatively, the use of a silane coupling agent as the dispersant is also advantageous.

The amount of the dispersant added is preferably from 0.1% to 30%, far preferably from 1% to 10%, based on the fine particles.

(First Solution B)

The first solution B is a solution differing from the first solution A in composition.

From the standpoint of forming the ink-receiving layer containing a sulfur compound in a greater quantity in its lower half than in its upper half, it is preferable to adopt, e.g., a method of adjusting the sulfur compound content in the first solution B to be lower than the sulfur compound content in the first solution A.

In other words, it is required that the content ratio of the sulfur compound [content (by mass) in the first solution B/content (by mass) in the first solution A] be lower than 1.0.

From the viewpoint of further enhancing effects of the invention, the content ratio is preferably from 0 to 0.6, far preferably from 0 to 0.3, particularly preferably 0 (which indicates a state in which the coating solution B contains no sulfur compound).

From the viewpoint of achieving the effects of the invention with higher efficiency, the sulfur compound content in the first solution B is preferably from 0 to 5% by mass, far preferably from 0 to 3% by mass, particularly preferably 0% by mass (which indicate a state in which the coating solution B contains no sulfur compound), based on the total solids in the first solution B.

In addition, the first solution B may contain other ingredients, such as inorganic fine particles, a water-soluble resin, a dispersant, a crosslinking agent, a mordant and a surfactant.

When the first solution B is applied, it is also preferable that the first solution B is subjected to in-line mixing with a solution containing the water-soluble polyvalent metal salt as recited above (preferably a basic polyaluminum chloride), and then applied.

Details of various ingredients including the inorganic fine particles, the water-soluble resin, the crosslinking agent, the mordant, the surfactant and the water-soluble polyvalent metal compound are the same as described in the section <Ink-Receiving Layer>, and preferred ranges of those ingredients are also the same as specified in that section. Explanation of the dispersant is the same as made in the description of the first solution A, and a preferred range of the dispersant is also the same.

Additionally, the first solution B can also be prepared in the same manner as the first solution A.

The first solution B is preferably acidic similarly to the first solution A, and the pH thereof is preferably 5.0 or below, far preferably 4.5 or below, further preferably 4.0 or below. The pH adjustment to such a range can be made by appropriately choosing the kind and addition amount of the cationic polymer (as a mordant and son on). Alternatively, the adjustment may be made by addition of an organic or inorganic acid. The first solution B having pH of 5.0 or below can inhibit more sufficiently, e.g., crosslinking reaction of the water-soluble resin with a crosslinking agent (a boron compound in particular) from occurring therein.

In addition, the first solution A and/or the first solution B may contain a cationic emulsion.

The cationic emulsion is an aqueous cationic emulsion or an aqueous emulsion modified by cationization, with examples including emulsions of conjugated diene copolymers, such as styrene-butadiene copolymer and methyl methacrylate-butadiene copolymer; emulsions of acrylic polymers, such as homo- or co-polymers of acrylate and methacrylate and homo- or co-polymers of acrylic acid and methacrylic acid; emulsions of styrene-acrylic copolymers, such as styrene-acrylate copolymers and styrene-methacrylate copolymers; emulsions of vinyl polymers, such as ethylene-vinyl acetate copolymer; and urethane emulsions which have urethane linkage and are cationized with cationic groups, emulsions whose surfaces are cationized with cationic surfactants, and emulsions which are polymerized in the presence of cationic polyvinyl alcohol and have surfaces on which the polyvinyl alcohol is spread. Of these cationic emulsions, cationic emulsions predominantly composed of urethane emulsions are preferred over the others.

Additionally, such a cationic emulsion can make up an organic nitrogen-containing cationic polymer when the ink-receiving layer is formed. The organic nitrogen-containing cationic polymer is the same as described in the section <Ink-Receiving Layer>, and the preferred range thereof is also the same.

(First Solution C)

The first solution C, which is used as required, is described below.

The first solution C preferably contains colloidal silica. By further applying the first solution C containing colloidal silica to the first solution B, the colloidal silica layer can be formed as the uppermost layer of the ink-receiving layer. As a result, the glossiness of the ink-receiving layer formed can further be enhanced.

The colloidal silica is the same as described in the section <Ink-Receiving Layer>, and the preferred range thereof is also the same.

The first solution C can be prepared by adding colloidal silica to ion exchange water and mixing them with stirring.

<Hardening Process>

The first aspect has a process in which cross-link curing of the coating layer formed in the coating-layer formation process is performed by applying a basic compound-containing second solution at either (1) the same time as at least the first solution A and the first solution B are applied, or (2) a stage in the course of drying of the coating layer formed by applying at least the first solution A and the first solution B, and that before the coating layer shows decreasing-rate drying.

Hereafter, this process is referred to as the hardening process too.

As a method of applying the second coating solution "(1) at the same time as at least the first solution A and the first solution B are applied", the mode of simultaneous coating (multilayer coating) in which the first solution A, the first solution B, the first solution C as required, and the second solution are applied simultaneously in the order of mention, the nearest the substrate first, is suitable. Alternatively, it may adopt a mode that the first solution A is applied and then, to the first solution A applied, the coating solution for the uppermost layer (the first solution B or the first solution C) and the second solution are applied simultaneously (which is also referred to as multilayer coating or simultaneous multilayer coating hereafter).

The simultaneous coating (multilayer coating) can be performed with known coating apparatus, such as an extrusion die coater or a curtain flow coater.

The mode of applying the second solution "(2) at a stage in the course of drying of the coating layer formed by applying at least the first solution A and the first solution B, and that before the coating layer shows decreasing-rate drying" is the method referred to as "Wet-On-Wet method" or "WOW method". Details of "Wet-On-Wet method" are described, e.g., in JP-A No. 2005-14593, paragraphs [0016] to [0037].

In the invention, application of the second solution can be carried out as follows: After a coating layer is formed by performing simultaneous coating (multilayer coating) or sequential coating of the first solution A and the first solution B (and further the first solution C as required) so that these solutions are applied in the order of mention from the substrate side, the second solution is applied at a stage in the course of drying of the coating layer formed, and that before the coating layer shows decreasing-rate drying, according to, e.g., (i) a method of further applying the second solution to the coating layer formed, (ii) a method of spraying the second solution on the coating layer formed, or (iii) a method of immersing the coating layer-provided substrate in the second solution.

Method available for applying the second layer coating liquid in the method (i) include methods known in the art such as using a curtain flow coater, extrusion die coater, air doctor coater, blade coater, rod coater, knife coater, squeeze coater, reverse roll coater and bar coater. The methods of using a extrusion die coater, curtain flow coater or bar coater are preferable, since these methods are able to apply the coat without making direct contact with the already formed first coated layer. The expression of "before the coating layer shows decreasing-rate drying" in the cross-link curing process usually refers to the course of several minutes right after application of coating solutions for the ink-receiving layer (which include the first solution A and the first solution B (and further the first solution C as required) in the invention), and in this course the coating layer applied exhibits the phenomenon of "constant-rate drying" in which the solvent (dispersion medium) content in the coating layer applied decreases in proportion to a lapse of time. On the time for such "constant-rate drying", there are descriptions in, e.g., Kagaku Kogaku Binran (Handbook of Chemistry), pp. 707-712, MARUZEN Co., Ltd. (Oct. 25, 1980).

As to conditions for drying the coating layer until it comes to show decreasing-rate drying, they are generally chosen from the drying temperature range of 40° to 180° C. and the drying time range of 0.5 to 10 minutes (preferably 0.5 to 5 minutes). Although it is natural that the drying time varies according to the application quantity, the range specified above is usually appropriate.

(Second Solution)

Then, the second solution for use in the ing curing process is described.

Basic Compound

The second solution for use in the invention contains at least one kind of basic compound.

Examples of such a basic compound include ammonium salts of weak acids, alkali metal salts of weak acids (such as lithium carbonate, sodium carbonate, potassium carbonate, lithium acetate, sodium acetate and potassium acetate), alkaline earth metal salts of weak acids (such as magnesium carbonate, barium carbonate, magnesium acetate and barium acetate), ammonium hydroxide, primary to tertiary amines (such as triethylamine, tripropylamine, tributylamine, trihexylamine, dibutylamine and butylamine), primary to tertiary anilines (such as diethylaniline, dibutylaniline, ethylaniline and aniline) and pyridines which may have substituents (such as 2-aminopyridine, 3-aminopyridine, 4-aminopyridine and 4-(2-hydroxyethyl)-aminopyridine).

In addition to the basic compounds recited above, combinations of these basic compounds with other basic substances and/or salts thereof can also be used. Examples of the other basic substances include ammonia, primary amines such as ethylamine and polyallylamine, secondary amines such as dimethylamine, tertiary amines such as N-ethyl-N-methylbutylamine, hydroxides of alkali metals and hydroxides of alkaline earth metals.

Of the basic compounds recited above, ammonium salts of weak acids are preferred over the others. The term "weak acids" refers to the acids having pKa of 2 or more among inorganic and organic acids described, e.g., in Kagaku Binran Kisohen II (Handbook of Chemistry Basic Edition II), published by MARUZEN Co., Ltd. Examples of the ammonium salts of weak acids include ammonium carbonate, ammonium hydrogen carbonate, ammonium borate, ammonium acetate and ammonium carbamate. However, they are not limited to those salts. Of those salts, ammonium carbonate, ammonium hydrogen carbonate and ammonium carbamate are preferred and effective in point of reduction in ink bleed, because they don't remain in the layer after drying.

Additionally, the basic compounds can be used as combinations of two or more thereof.

The content of the basic compound(s) (notably the ammonium salt of an weak acid) in the second solution is preferably from 0.5% to 10% by mass, far preferably from 1% to 5% by mass, based on all the ingredients (including the solvent) of the second solution. By adjusting the content of basic compound(s) (notably the ammonium salt of an weak acid) to the foregoing range in particular, a sufficient degree of hardening can be attained and impairment of a working environment by too high an ammonia concentration can be avoided.

Metal Compound

The second solution for use in the invention preferably contains at least one kind of metal compound.

As to the metal compound to be incorporated in the second solution, any compounds are usable as long as they are stable under basic conditions. Specifically, any of the water-soluble polyvalent metal salts as recited above, metal complex compounds, inorganic oligomers and inorganic polymers may be used. More specifically, zirconium compounds and the compounds recited as inorganic mordants in JP-A No. 2005-14593, paragraphs [0100] and [0101], are used to advantage. And examples of usable metal complex compounds include the metal complexes described in Kagaku Sosetsu (Review of Chemistry), No. 32 (1981), edited by The Chemical Society of Japan, and the transition metal complexes containing transition metals including ruthenium as described in Coordination Chemistry Review, vol. 84, pp. 85-277 (1988), and JP-A No. 2-182701.

Of the compounds recited above, zirconium compounds and zinc compounds, especially zirconium compounds, are preferred over the others. Examples of such zirconium compounds include ammonium zirconium carbonate, ammonium zirconium nitrate, potassium zirconium carbonate, ammonium zirconium citrate, zirconium stearate, zirconium octylate, zirconyl nitrate, zirconium oxychloride and zirconium hydroxychloride. Of these zirconium compounds, ammonium zirconium carbonate is used to particular advantage. In the second solution, two or more metal compounds (preferably including a zirconium compound) may also be used in combination.

The metal compound content (notably the zirconium compound content) in the second solution is preferably from 0.05% to 5% by mass, far preferably from 0.1% to 2% by mass, based on all the ingredients (including the solvent) of the second solution. By adjusting the metal compound content (notably the zirconium compound content) to the range specified above, not only hardening of the coating layer can be fully achieved, but also insufficient print density and beading due to reduction in mordanting capability can be avoided, and besides, no deterioration of a working environment due to too high a concentration of basic compound, such as ammonia, is caused. Additionally, two or more kinds of metal compounds may be used in combination. When the metal compounds are used in combination with a mordant other than metal compounds among the mordant components described hereafter, the total content of the metal compounds and the mordant is adjusted to fall within the range specified above and not to cause impairment of effects of the invention.

In point of ozone resistance, it is also preferable that the second solution contains as a metal compound any of the magnesium salts recited above. As the magnesium salt contained, magnesium chloride is particularly suitable.

In this case, the amount of the magnesium salt added is preferably from 0.1% to 1% by mass, far preferably from 0.15% to 0.5% by mass, based on all the ingredients of the second solution.

The second solution can further contain a crosslinking agent and other mordant components as required.

The second solution can accelerate hardening when used in a state of alkaline solution, so the pH thereof is adjusted preferably to 7.1 or higher, far preferably to 8.0 or higher, particularly preferably to 9.0 or higher. When the pH is 7.1 or higher, the crosslinking reaction of the water-soluble resin which may be contained in the first solution A and/or the first solution B can progress faster, and bronzing and cracking in the ink-receiving layer can be prevented more effectively.

The second solution can be prepared, e.g., by adding to ion exchange water a metal compound (such as a zirconium compound in a concentration of, e.g., 1 to 5%) and a basic compound (such as ammonium carbonate in a concentration of, e.g., 1 to 5%), and further paratoluenesulfonic acid (in, e.g., 0.5 to 3%) as required, and then thoroughly stirring them. Additionally, "%" of each ingredient represents % by mass on a solids basis.

As to the solvent for preparation of the second solution, water, an organic solvent or a mixture thereof is usable. Examples of an organic solvent which can be used for application include alcohol compounds such as methanol, ethanol, n-propanol, isopropanol and methoxypropanol, ketones such as acetone and methyl ethyl ketone, tetrahydrofuran, acetonitrile, ethyl acetate and toluene.

<Cooling Process and Drying Process>

The second aspect has a process of cooling the coating layer formed in the coating layer formation process to a temperature at least 5° C. lower than lower one of temperatures at which the first solution A and the first solution B are applied, respectively (hereinafter referred to as "a cooling process" too), and a process of forming an ink-receiving layer by drying the coating layer cooled (hereinafter referred to as "a drying process" too).

As a method of cooling the coating layer in the cooling process, it is preferable to adopt a method of cooling the substrate, on which the coating layer is formed, in a cooling zone kept at temperatures ranging from 0° to 20° C. The method of cooling for 5 to 30 seconds in a cooling zone kept at temperatures ranging from 0° to 10° C. is far preferred.

The temperature of the cooling zone is preferably from 10° C. to 20° C.

Herein, the temperature of the coating layer can be determined by temperature measurement made on the coating surface.

<Other Processes>

In the first aspect and the second aspect, the surface smoothness, glossiness, transparency and strength of coated layer may be improved by applying calendar treatment by heating and passing the sheet through roll nips under pressure, using a super calendar or gloss calendar machine after forming the ink receiving layer is formed on the substrate. However, since in some cases the calendar treatment may cause a decrease of the porosity (resulting in a decrease in ink absorbing property), conditions that give a small decrease of the porosity should be employed.

The roll temperature in the case of performing calendar treatment is preferably from 30° to 150° C., far preferably from 40° to 100° C.

And the linear pressure between rolls at the time of calendar treatment is preferably from 50 to 400 kg/cm, far preferably from 100 to 200 kg/cm.

<<Inkjet Recording Method>>

As to the inkjet recording method for recording images on the present inkjet recording medium, there is no particular restriction, and various known methods can be adopted which include a charge control method in which jets of ink are discharged by utilizing electrostatic attraction, a drop-on-demand method (a pressure pulse method) which utilizes vibration pressure of a piezoelectric element, an acoustic inkjet method in which ink is irradiated with acoustic beams converted from electric signals and the radiation pressure generated thereby is utilized for ink jetting, and a thermal inkjet method in which bubbles are formed by heating of ink and the pressure generated thereby is utilized. In addition, a method in which small volumes of great many droplets of low-density ink referred to as photo ink are made to jet out, a method of improving image quality by using plural kinds of ink having substantially the same color hue but differing in density, and a method of using colorless, transparent ink are included in the foregoing inkjet recording methods.

EXAMPLES

The present invention will now be illustrated in more detail by reference to the following examples, but the invention should not be construed as being limited by these examples.

Additionally, all "parts" and all "%" in the examples are by mass unless otherwise indicated.

Example 1

Production of Inkjet Recording Medium

<Making of Substrate>

Wood pulp constituted of 100 parts of LBKP was beaten to a Canadian freeness of 300 ml by means of a double disk refiner, and thereto 0.5 parts of epoxidized behenic acid amide, 1.0 parts of anionic polyacrylamide, 0.1 parts of polyamidepolyamine epichlorohydrin and 0.5 parts of cationic polyacrylamide were added in absolute dry mass ratio to the pulp. The resulting pulp was made into raw paper with a basis weight of 170 g/m$^2$ by means of a Fourdrinier paper machine.

For sizing the surface of the raw paper made, the raw paper was impregnated with a 4% aqueous polyvinyl alcohol solution, to which 0.04% of a fluorescent whitening agent (Whitex BB, trade name, manufactured by Sumitomo Chemical Co., Ltd.) was added, so as to form a 0.5 g/m$^2$ of size coating on a absolute dry weight basis, dried and then subjected to calender treatment, thereby preparing base paper adjusted to a density of 1.05.

The base paper obtained was given corona discharge treatment on the wire side (the back side), and then high-density polyethylene was coated on the corona-discharged surface by means of a melt extruder so as to have a film thickness of 19 μm, thereby forming a resin layer having a matte surface (this resin layer surface is referred to as "the back surface" hereafter). The resin layer on the back side was further given corona discharge treatment, and thereto a dispersion prepared by dispersing into water an antistatic agent containing aluminum oxide (ALUMINA SOL 100, trade name, manufactured by Nissan Chemical Industries, Ltd.) and silicon dioxide (SNOWTEX O, trade name, manufactured by Nissan Chemical Industries, Ltd.) at a ratio of 1:2 by mass was applied so as to have a dry weight of 0.2 g/m$^2$.

Further, the base paper was given corona discharge treatment on the felt side (the top side) where the resin layer was not provided, and then low-density polyethylene having a MFR (melt flow rate) of 3.8 and containing 10% of anatase-type titanium dioxide, a very small amount of ultramarine blue and 0.01% of a fluorescent whitening agent (based on the polyethylene) was melted and extruded onto the corona-discharged surface by means of a melt extruder so as to have a film thickness of 29 μm, thereby forming a high-gloss thermoplastic resin layer on the top side of the base paper (this high-gloss surface is referred to as "the front surface" hereafter). The thus treated base paper was used as substrate in the present example.

<Preparation of First Solution B (for Upper Layer)>

As shown in the following composition, (1) vapor-phase process silica fine particles, (2) ion exchange water, (3) SHALLOL DC-902P and (4) ZA-30 were mixed, and dispersed with a liquid-liquid collision dispersing machine (ULTIMIZER, trade name, made by Sugino Machine Ltd.). Then, the dispersion obtained was heated up to 45° C. and kept for 20 hours as it was. Thereafter, (5) a polyvinyl alcohol-dissolved liquor was added to the dispersion at a temperature of 30° C., thereby preparing a first solution B (for the upper layer).

The mass ratio of the silica fine particles to the water-soluble resin (PB ratio=(1):(5)) was 4.0:1, and the first solution B (for the upper layer) was acidic and the pH thereof was 3.4.

Composition of First Solution B (for Upper Layer):

| | |
|---|---|
| (1) Vapor-phase process silica fine particles (inorganic fine particles, AEROSIL 300SF75, trade name, manufactured by NIPPON AEROSIL CO., LTD.) | 8.9 parts |
| (2) Ion exchange water | 1.0 parts |
| (3) SHALLOL DC-902P (51.5% aqueous solution, trade name, a dispersant manufactured by DAI-ICHI KOGYO SEIYAKU CO., LTD.) | 0.78 parts |
| (4) ZA-30 (trade name, zirconium acetate manufactured by DAIICHI KIGENSO KAGAKU KOGYO CO., LTD.) | 0.48 parts |
| (5) Polyvinyl alcohol (water-soluble resin) - dissolved liquor | 31.2 parts |
| Composition of Dissolved Liquor: | |
| PVA235 (trade name, saponification degree: 88%, polymerization degree: 3,500, manufactured by KURARAY CO., LTD.) | 2.2 parts |
| Ion exchange water | 28.2 parts |
| Diethylene glycol monobutyl ether (Butycenol 20P, trade name, manufactured by Kyowa Hakko Chemicals Co., Ltd.) | 0.7 parts |
| EMULGEN 109P (trade name, a surfactant manufactured by Kao Corporation) | 0.1 parts |

<Preparation of First Solution A (for Lower layer)>

As shown in the following composition, (1) vapor-phase process silica fine particles, (2) ion exchange water, (3) SHALLOL DC-902P, (4) ZA-30 and (5) 30% methionine sulfoxide were mixed, and dispersed with a liquid-liquid collision dispersing machine (ULTIMIZER, trade name, made by Sugino Machine Ltd.). Then, the dispersion obtained was heated up to 45° C. and kept for 20 hours as it was. Thereafter, (6) boric acid and (7) a polyvinyl alcohol-dissolved liquor were added to the dispersion at a temperature of 30° C., thereby preparing a first solution A (for the lower layer).

The mass ratio of the silica fine particles to the water-soluble resin (PB ratio=(1):(7)) was 4.0:1, and the first solution A (for lower layer) was acidic and the pH thereof was 3.8.

Composition of First Solution A (for Lower Layer):

| | |
|---|---|
| (1) Vapor-phase process silica fine particles (inorganic fine particles, AEROSIL 300SF75, trade name, manufactured by NIPPON AEROSIL CO., LTD.) | 8.9 parts |
| (2) Ion exchange water | 1.0 parts |
| (3) SHALLOL DC-902P (51.5% aqueous solution, trade name, a dispersant manufactured by DAI-ICHI KOGYO SEIYAKU CO., LTD.) | 0.78 parts |
| (4) ZA-30 (trade name, zirconium acetate manufactured by DAIICHI KIGENSO KAGAKU KOGYO CO., LTD.) | 0.24 parts |
| (5) 30% Methionine sulfoxide (sulfur compound) | 1.76 parts |
| (6) Boric acid (crosslinking agent) | 0.4 parts |
| (7) Polyvinyl alcohol (water-soluble resin) - dissolved liquor | 31.2 parts |
| Composition of Dissolved Liquor | |
| PVA235 (trade name, saponification degree: 88%, polymerization degree: 3500, manufactured by KURARAY CO., LTD.) | 2.2 parts |
| Ion exchange water | 28.2 parts |
| Diethylene glycol monobutyl ether (Butycenol 20P, trade name, manufactured by Kyowa Hakko Chemicals Co., Ltd.) | 0.7 parts |
| EMULGEN 109P (trade name, a surfactant manufactured by Kao Corporation) | 0.1 parts |

<Preparation of First Solution C (for Uppermost Layer)>

A first solution C (for the uppermost layer) was prepared by mixing and stirring the following ingredients in amounts shown below.

Composition of First Solution C (for Uppermost Layer):

| | |
|---|---|
| (1) PL-3L (trade name, colloidal silica manufactured by FUSO CHEMICAL CO., LTD., average primary grain size: 32 nm) | 2.5 parts |
| (2) Ion exchange water | 97.5 parts |

<Formation of Ink-Receiving Layer>

After corona discharge treatment was given to the front surface of the substrate, the first solution A (for the lower layer), the first solution B (for the upper layer) and the first solution C (for the uppermost layer) were applied to the front surface by means of an extrusion die coater according to a simultaneous multilayer coating method, thereby forming a coating layer.

Specifically, the following procedure was carried out in the simultaneous multilayer coating: The first solution A (for the lower layer) and the following in-line solution were subjected to in-line mixing at rates of 96 ml/m$^2$ and 6.0 ml/m$^2$, respectively, and the resulting mixture was applied as the lower layer; the first solution B (for the upper layer) and the following in-line solution were subjected to in-line mixing at rates of 91 ml/m$^2$ and 6.0 ml/m$^2$, respectively, and the resulting mixture was applied as the upper layer; and the first solution C (for the uppermost layer) was applied at a rate of 0.1 ml/m$^2$ as the uppermost layer. The layer structure thus formed was first solution C (for the uppermost layer)/first solution B (for the upper layer)/first solution A (for the lower layer)/substrate.

Composition of In-Line Solution:

| | |
|---|---|
| (1) ALFINE 83 (trade name, manufactured by TAIMEI Chemicals Co., Ltd.) | 2.0 parts |
| (2) Ion exchange water | 7.8 parts |
| (3) HYMAX SC-505E (trade name, dimethylamine-epichlorohydrin polycondensate, manufactured by HYMO Co., Ltd.) | 0.2 parts |

The coating layer formed by the simultaneous multilayer coating method was dried at 80° C. with a hot-air dryer (air velocity: 3 to 8 m/sec) until the solids concentration therein reached 24%. During this period, the coating layer showed a constant-rate drying speed. Immediately thereafter, the coating layer was immersed for 3 seconds in a second solution having the following composition, and thereby 13 g/m$^2$ of the second solution was deposited on the coating layer surface, and further 10-minute drying at 72° C. was carried out (drying process). Thus, an ink-receiving layer was formed on the substrate.

Composition of Second Solution:

| | |
|---|---|
| (1) Boric acid | 1.3 parts |
| (2) Ammonium carbonate (first grade, manufactured by KANTO CHEMICAL CO., INC.) | 5.0 parts |
| (3) Zircosol AC-7 (trade name, ammonium zirconyl carbonate manufactured by DAIICHI KIGENSO KOGYO CO., LTD.) | 2.5 parts |
| (4) Ion exchange water | 85.2 parts |
| (5) Polyoxyethylene lauryl ether (surfactant, EMULGEN 109P, trade name, manufactured by Kao Corporation, 10% aqueous solution, HLB value: 13.6) | 6.0 parts |

In the foregoing manner, an inkjet recording medium according to the invention, which had on the substrate the ink-receiving layer having a dry thickness of 35 μm, was produced.

<<Evaluation>>

The following evaluations were made on the inkjet recording medium thus produced. Evaluation results are shown in Table 1.

<Method of Evaluating Ozone Resistance>

Ozone resistance of magenta and cyan were evaluated as follows.

By use of an inkjet printer (the model PM-A820 from EPSON) loaded with a manufacturer-authorized ink set including magenta ink and cyan ink, a solid magenta image was printed on a recording medium sample, and stored for 72 hours in an atmosphere having a temperature of 23° C., a relative humidity of 60% and an ozone concentration of 10 ppm. The residual rate of magenta density was determined from the magenta densities after and before the storage, and ozone resistance of magenta was evaluated on the following criteria.

Likewise, a solid cyan image was printed and ozone resistance of cyan was evaluated.

Evaluation Criteria:

A: Residual rate is higher than 75%.

B: Residual rate is in the 60%-to-75% range.

C: Residual rate is lower than 60%.

<Measurement of Print Density>

Printing of a solid black image was done with the inkjet printer PM-A820, and the density of the black portion obtained was measured with a reflection densitometer (the model X-Rite 938 from X-Rite, Incorporated).

<Glossiness>

Glossiness of the ink-receiving layer surface of the inkjet recording medium before printing was measured at a measurement angle of 60 degrees by means of a digital variable gloss meter (the model UGV-50DP from SUGA TEST INSTRUMENTS CO., LTD.).

<Ascertainment of Presence Distribution of Sulfur Compound>

A cross section of the inkjet recording medium obtained is cut away with a microtome, and mapping analyses of elemental Si and S were carried out with SEM-EDX (a combination of S-2150 from Hitachi Ltd. with EDX apparatus). By the mapping image of elemental Si, the presence position of the ink-receiving layer was ascertained, and the mapping image of elemental S was observed in juxtaposition with the mapping image of elemental Si.

Evaluation Criteria:

a: Quantity of elemental S present in the lower half of ink-receiving layer>quantity of elemental S present in the upper half of ink-receiving layer b: Quantity of elemental S present in the lower half of ink-receiving layer≦quantity of elemental S present in upper half of ink-receiving layer

Example 2

An inkjet recording medium was produced in the same manner as in Example 1, except that the first solution C (for the uppermost layer) was not applied, and evaluations thereof were made according to the same methods as in Example 1. Evaluation results obtained are also shown in Table 1.

Example 3

An inkjet recording medium was produced in the same manner as in Example 2, except that the operation of mixing the ingredients (1) to (4) in preparation of the first solution B (for the upper layer) in Example 2 was replaced by operation of mixing not only the ingredients (1) to (4) but also 0.59 parts of a 30% aqueous solution of methionine sulfoxide, while the content of a 30% aqueous solution of methionine sulfoxide in the first solution A (for the lower layer) was changed to 1.17 parts. On the thus obtained inkjet recording medium, evaluations were made according to the same methods as in Example 2. Evaluation results obtained are also shown in Table 1.

Example 4

After corona discharge treatment was given to the front surface of the substrate made in Example 1, high-frequency corona discharge treatment was further given to the surface of the polyolefin resin-coated paper, and the resulting front surface was coated with a subbing layer having the following composition so as to have a gelatin coverage of 50 mg/m$^2$, and dried. Thus, a substrate to be used in this example was prepared (hereafter the subbing layer surface is referred to as the front surface of the substrate too). Additionally, the term "parts" represents parts by mass on a solids basis.

Composition of Subbing Layer:

| | |
|---|---|
| Lime-processed gelatin | 100 parts |
| 2-Ethylhexyl sulfosuccinate | 2 parts |
| Chrome alum | 10 parts |

To the front surface, the first solution A (for the lower layer), the first solution B (for the upper layer) and the first solution C (for the uppermost layer) were applied with an extrusion die coater in accordance with a simultaneous multilayer coating method, thereby forming a coating layer. Herein, the compositions of the first solution A (for the lower layer), the first solution B (for the upper layer) and the first solution C (for the uppermost layer) were the same as the first solution A (for the lower layer), the first solution B (for the upper layer) and the first solution C (for the uppermost layer) in Example 1, respectively.

Specifically, the following procedure was carried out in the simultaneous multilayer coating: The first solution A (for the lower layer) and the foregoing in-line solution were subjected to in-line mixing at rates of 96 ml/m$^2$ and 2.0 ml/m$^2$, respectively, and the resulting mixture was applied as the lower layer; the first solution B (for the upper layer) and the foregoing in-line solution were subjected to in-line mixing at rates of 91 ml/m$^2$ and 2.0 ml/m$^2$, respectively, and the resulting mixture was applied as the upper layer; and the first solution C (for the uppermost layer) was applied at a rate of 0.1 ml/m$^2$ as the uppermost layer. The layer structure thus formed was first solution C (for the uppermost layer)/first solution B (for the upper layer)/first solution A (for the lower layer)/substrate.

In addition, the temperature of each solution at the time of application was checked with a film-surface thermometer, and it was found that the temperatures of the first solutions A (for the lower layer), B (for the upper layer) and C (for the uppermost layer) were all 30° C.

The substrate on which the coating layer was formed by the simultaneous multilayer coating was cooled for 20 seconds in a cooling zone kept at 0° C. By this cooling, the temperature of the coating layer was lowered to 15° C. from 30° C. which was the temperature of the first solutions A to C before cooling. After the cooling, the coating layer was dried at 80° C. by means of a hot-air dryer (air velocity: 3 to 8 m/sec). Thus, an ink-receiving layer was formed on the substrate, and an inkjet recording medium was obtained.

On the thus obtained inkjet recording medium, evaluations was made according to the same methods as in Example 1. Evaluation results obtained are also shown in Table 1.

Example 5

An inkjet recording medium was produced in the same manner as in Example 2, except that the composition of the second solution was changed to the following composition, and evaluations thereof were made according to the same methods as in Example 2. Evaluation results obtained are also shown in Table 1.

Composition of Second Solution:

| | |
|---|---|
| (1) Boric acid | 1.3 parts |
| (2) Ammonium carbonate (first grade, manufactured by KANTO CHEMICAL CO., INC.) | 5.0 parts |
| (3) Magnesium chloride (White Nigari NS, trade name, manufactured by Naikai Salt Industries Co., Ltd.) | 2.5 parts |
| (4) Ion exchange water | 87.7 parts |
| (5) Polyoxyethylene lauryl ether (surfactant, EMULGEN 109P, trade name, manufactured by Kao Corporation, 10% aqueous solution, HLB value: 13.6) | 6.0 parts |

Comparative Example 1

An inkjet recording medium was produced in the same manner as in Example 2, except that the first solution B (for the upper layer) was applied as the lower layer and the first solution A (for the lower layer) was applied as the upper layer, and evaluated in accordance with the same methods as in Example 2. Evaluation results obtained are also shown in Table 1.

Comparative Example 2

An inkjet recording medium was produced in the same manner as in Example 2, except that, instead of the simultaneous multilayer coating of the first solution A (for the lower layer) and the first solution B (for the upper layer), the first solution A (for the lower layer) and the foregoing in-line solution were subjected to in-line mixing at rates of 187 ml/m$^2$ and 24.2 ml/m$^2$, respectively, and then the resulting mixture was applied into a single layer. On the thus produced inkjet recording medium, evaluations were made in accordance with the same methods as in Example 2. Evaluation results obtained are also shown in Table 1.

Comparative Example 3

A first solution A (for lower layer) was prepared in the same manner as in Comparative Example 2, except that (5) 30% methionine sulfoxide was not added in the preparation of the first solution A (for lower layer) in Comparative Example 2.

By using the first solution A (for lower layer) thus prepared, an inkjet recording medium was produced in the same manner as in Comparative Example 2, and evaluated by the same methods as in Comparative Example 2. Evaluation results obtained are also shown in Table 1.

TABLE 1

| | Ink-Receiving Layer | | | | Evaluation Results | | | | |
|---|---|---|---|---|---|---|---|---|---|
| | Half on Far-Substrate Side | Half on Near-Substrate Side | Content Ratio of Sulfur Compound | Uppermost Layer (colloidal silica layer) | Image Density | Ozone Resistance Cyan | Ozone Resistance Magenta | Glossiness (%) | Presence Distribution of Sulfur Compound |
| Example 1 | — | Sulfur compound | 0 | present | 2.40 | B | A | 50 | a |
| Example 2 | — | Sulfur compound | 0 | absent | 2.45 | B | A | 45 | a |
| Example 3 | Sulfur compound | Sulfur compound | 0.5 | absent | 2.35 | B | A | 42 | a |
| Example 4 | — | Sulfur compound | 0 | present | 2.43 | B | A | 52 | a |
| Example 5 | Magnesium chloride | Sulfur compound | 0 | absent | 2.40 | A | A | 45 | a |
| Comparative Example 1 | Sulfur compound | — | 1.0<< | absent | 2.10 | B | A | 44 | b |
| Comparative Example 2 | Sulfur compound | Sulfur compound | 1.0 | absent | 2.10 | B | A | 43 | b |
| Comparative Example 3 | — | — | — | absent | 2.45 | B | C | 45 | b |

In Table 1, the columns "Half on Far-Substrate Side" and "Half on Near-Substrate Side" indicate which position in the ink-receiving layer each of the sulfur compound and magnesium chloride was contained in.

On the other hand, the column "Content Ratio of Sulfur Compound" in Table 1 indicates the content ratio of the sulfur compound in the ink-receiving layer [content (by mass) in the upper half of the ink-receiving layer/content (by mass) in the lower half of the ink-receiving layer].

As can be seen from Table 1, the inkjet recording media produced in Examples 1 to 5 had excellent ozone resistance as well as high image density.

On the other hand, the image density was lowered in both Comparative Example 1, wherein the sulfur compound was incorporated into only the upper half of the ink-receiving layer, and Comparative Example 2, wherein the content ratio of the sulfur compound [content (by mass) in the upper half of the ink-receiving layer/content (by mass) in the lower half of the ink-receiving layer] was 1.0. And the ozone resistance was degraded in Comparative Example 3 where no sulfur compound was incorporated.

<1> An inkjet recording medium comprising, on a substrate, an ink-receiving layer comprising, inorganic fine particles and a sulfur compound, the sulfur compound being contained in a greater quantity in a half of the ink-receiving layer at a side nearer to the substrate (a near-substrate side) than in a half of the ink-receiving layer at a side further from the substrate (a far-substrate side) when the ink-receiving layer is divided into two equal parts by a plane parallel to the substrate.

<2> The inkjet recording medium of <1>, wherein a ratio of the content by mass of the sulfur compound in the far-substrate side half of the ink-receiving layer to that of the sulfur compound in the near-substrate side half of the ink-receiving layer is from 0 to 0.6 when the ink-receiving layer is divided into two equal parts by a plane parallel to the substrate.

<3> The inkjet recording medium as described in <1>, wherein the sulfur compound is a compound selected from thioether compounds or sulfoxide compounds.

<4> The inkjet recording medium as described in <1>, wherein the ink-receiving layer further contains a magnesium salt.

<5> The inkjet recording medium as described in <1> or <2>, wherein the ink-receiving layer has two or more constituent layers and its uppermost layer lying most distant from the substrate contains colloidal silica.

<6> The inkjet recording medium as described in any one of <1> to <5>, wherein the inorganic fine particles are silica particles synthesized by a vapor-phase process.

<7> The inkjet recording medium as described in any one of <1> to <6>, wherein the ink-receiving layer further contains a water-soluble resin.

<8> The inkjet recording medium as described in <7>, wherein the water-soluble resin is polyvinyl alcohol.

<9> The inkjet recording medium as described in any one of <1> to <8>, wherein the ink-receiving layer further contains a crosslinking agent.

<10> The inkjet recording medium as described in <9>, wherein the crosslinking agent is boric acid.

<11> A method of manufacturing an inkjet recording medium, comprising:

forming a coating layer on a substrate by applying to the substrate at least a first solution A containing inorganic fine particles and a sulfur compound and a first solution B differing from the first solution A in composition in this order from the substrate, and performing cross-link curing of the coating layer by applying a second solution containing a basic compound at either (1) the same time as at least the first solution A and the first solution B are applied or (2) a stage in the course of drying of the coating layer formed by applying at least the first solution A and the first solution B before the coating layer shows decreasing-rate drying, wherein an ink-receiving layer is formed that includes the coating layer having undergone the cross-link curing and contains the sulfur compound in a greater quantity in half at a side nearer to the substrate (a near-substrate side) than in half at a side further from the substrate (a far-substrate side) when the ink-receiving layer is divided into two equal parts by a plane parallel to the substrate.

<12> A method of manufacturing an inkjet recording medium, comprising:

forming a coating layer on a substrate by applying to the substrate at least a first solution A containing inorganic fine particles and a sulfur compound and a first solution B differing from the first solution A in composition in this order from the substrate, cooling the coating layer to a temperature at least 5° C. lower than a lower temperature of temperatures at which the first solution A and the first solution B are applied respectively, and forming an ink-receiving layer by drying the cooled coating layer, wherein the formed ink-receiving layer contains the sulfur compound in a greater quantity in half at a side nearer to the substrate (a near-substrate side) than in half at a side further from the substrate (a far-substrate side) when the ink-receiving layer is divided into two equal parts by a plane parallel to the substrate.

All publications, patent applications, and technical standards mentioned in this specification are herein incorporated by reference to the same extent as if each individual publication, patent applications, and technical standards was specifically and individually indicated to be incorporated by reference.

What is claimed is:

1. An inkjet recording medium comprising, on a substrate, an ink-receiving layer comprising, inorganic fine particles and a sulfur compound, the sulfur compound being contained in a greater quantity in a half of the ink-receiving layer at a side nearer to the substrate (a near-substrate side) than in a half of the ink-receiving layer at a side further from the substrate (a far-substrate side) when the ink-receiving layer is divided into two equal parts by a plane parallel to the substrate, wherein the sulfur compound is a compound selected from thioether compounds or sulfoxide compounds.

2. The inkjet recording medium of claim 1, wherein a ratio of the content by mass of the sulfur compound in the far-substrate side half of the ink-receiving layer to that of the sulfur compound in the near-substrate side half of the ink-receiving layer is from 0 to 0.6 when the ink-receiving layer is divided into two equal parts by a plane parallel to the substrate.

3. The inkjet recording medium as described in claim 1, wherein the ink-receiving layer further contains a magnesium salt.

4. The inkjet recording medium as described in claim 1, wherein the ink-receiving layer has two or more constituent layers, and its uppermost layer lying most distant from the substrate contains colloidal silica.

5. The inkjet recording medium as described in claim 1, wherein the inorganic fine particles are silica particles synthesized by a vapor-phase process.

6. The inkjet recording medium as described in claim 1, wherein the ink-receiving layer further contains a water-soluble resin.

7. The inkjet recording medium as described in claim 6, wherein the water-soluble resin is polyvinyl alcohol.

8. The inkjet recording medium as described in claim 1, wherein the ink-receiving layer further contains a crosslinking agent.

9. The inkjet recording medium as described in claim 8, wherein the crosslinking agent is boric acid.

10. A method of manufacturing an inkjet recording medium, comprising:

forming a coating layer on a substrate by applying to the substrate at least a first solution A containing inorganic fine particles and a sulfur compound and a first solution B differing from the first solution A in composition in this order from the substrate, and performing cross-link curing of the coating layer by applying a second solution containing a basic compound at either (1) the same time as at least the first solution A and the first solution B are applied or (2) a stage in the course of drying of the coating layer formed by applying at least the first solution A and the first solution B before the coating layer shows decreasing-rate drying, wherein an ink-receiving layer is formed that includes the coating layer having undergone the cross-link curing and contains the sulfur compound in a greater quantity in half at a side nearer to the substrate (a near-substrate side) than in half at a side further from the substrate (a far-substrate side) when the ink-receiving layer is divided into two equal parts by a plane parallel to the substrate wherein the sulfur compound is a compound selected from thioether compounds or sulfoxide compounds.

11. A method of manufacturing an inkjet recording medium, comprising:

forming a coating layer on a substrate by applying to the substrate at least a first solution A containing inorganic fine particles and a sulfur compound and a first solution B differing from the first solution A in composition in this order from the substrate, cooling the coating layer to a temperature at least 5° C. lower than a lower temperature of temperatures at which the first solution A and the first solution B are applied respectively, and forming an ink-receiving layer by drying the cooled coating layer, wherein the formed ink-receiving layer contains the sulfur compound in a greater quantity in half at a side nearer to the substrate (a near-substrate side) than in half at a side further from the substrate (a far-substrate side) when the ink-receiving layer is divided into two equal parts by a plane parallel to the substrate wherein the sulfur compound is a compound selected from thioether compounds or sulfoxide compounds.

* * * * *